US006281626B1

(12) United States Patent
Nakamura et al.

(10) Patent No.: US 6,281,626 B1
(45) Date of Patent: Aug. 28, 2001

(54) COLD EMISSION ELECTRODE METHOD OF MANUFACTURING THE SAME AND DISPLAY DEVICE USING THE SAME

(75) Inventors: Osamu Nakamura, Kodaira; Shigemi Suzuki, Yokohama; Yuichi Mori, Toda; Hironori Hirama, Machida, all of (JP)

(73) Assignees: Casio Computer Co., Ltd.; Stanley Electric Co., Ltd., both of Tokyo (JP)

( * ) Notice: Subject to any disclaimer, the term of this patent is extended or adjusted under 35 U.S.C. 154(b) by 0 days.

(21) Appl. No.: 09/271,138

(22) Filed: Mar. 17, 1999

(30) Foreign Application Priority Data

Mar. 24, 1998 (JP) ..... 10-076210
Mar. 2, 1999 (JP) ..... 11-054557

(51) Int. Cl.[7] ..... H01J 1/30; H01J 1/316

(52) U.S. Cl. ..... 313/491; 313/574; 313/631; 313/346 R; 313/355; 313/311; 313/495

(58) Field of Search ..... 313/491, 572, 313/574, 575, 631, 632, 346 R, 355, 311, 581, 582, 495, 309, 336, 351

(56) References Cited

U.S. PATENT DOCUMENTS 3,611,077 * 10/1971 Smith ..... 313/311 X
4,360,757 * 11/1982 Hahndorf ..... 313/346 R
5,237,241 8/1993 Hashimoto .
5,705,887 * 1/1998 Shaffer ..... 313/631

* cited by examiner

*Primary Examiner*—Ashok Patel
(74) *Attorney, Agent, or Firm*—Frishauf, Holtz, Goodman, Langer & Chick, P.C.

(57) ABSTRACT

An yttrium film is formed on the surface of a substrate made of an Ni—Cr-based material by deposition or sputtering using resistance heating or an electron beam. The yttrium film is heated in an inert gas atmosphere containing a very small amount of hydrogen to hydrogenate yttrium. The resultant yttrium hydride is excellent as a cold emission material for a cold emission electrode and can be used for a cold emission discharge fluorescent tube.

19 Claims, 16 Drawing Sheets

COLD EMISSION ELECTRODE METHOD OF MANUFACTURING THE SAME AND DISPLAY DEVICE USING THE SAME

BACKGROUND OF THE INVENTION

The present invention relates to a cold emission electrode, particularly, a cold emission electrode suitable for a discharge device using a cold emission phenomenon, a method of manufacturing the cold emission electrode, and a display device comprising the same.

A thermoelectronic emission phenomenon, photoemission phenomenon, cold emission phenomenon, and the like are known as electron emission phenomena in which electrons existing in an object are emitted into space. In practice, an electron emitting electrode material is used to form an electrode for a device utilizing discharge, such as a discharge lamp. For example, there is known a thermoelectronic emission discharge lamp using the thermoelectronic emission phenomenon in which electrons are emitted by supplying a current to, e.g., a coil filament to heat it.

Unlike the above example, devices using various types of discharge using electrodes utilizing cold emission phenomenon are also known. Field emission display devices using electron emission using a strong electric field, cold emission discharge tubes and plasma display panels utilizing secondary electron emission upon mainly ionic collision, and the like are commercially available.

Secondary electron emission as an electron emission mechanism unique to a cold emission discharge tube is potential type emission or kinetic type emission. In the potential type emission, electrons are emitted by an energy given by a so-called Auger effect, in which when a cation comes close to a cold cathode, the level of an electron lowers to the ground state of the cation because the level of the electron in the electrode is higher than that of the cation, and the energy generated by this level difference is applied to another electron. The kinetic type emission is emission from the cold cathode upon reception of an energy, the energy being generated when a cation comes into collision with the cold cathode. Glow discharge unique to the cold emission tube occurs due to the above electron emission mechanism.

A cold emission discharge fluorescent tube or plasma display panel which emits visible light upon this glow discharge comprises a vessel having a plurality of electrodes and an inner wall coated with a fluorescent material and a mixture of a rare gas and mercury sealed in the vessel. Electrons emitted in accordance with the photoemission phenomenon by light incident on the cold emission discharge fluorescent tube initially move by an electric field applied to the electrodes and come into collision with the gas and the like sealed in the vessel, thereby ionizing gas to produce ions. These ions collide with the electrodes to generate secondary electrons. The electrons emitted by the cold emission electrode collide with vaporous mercury atoms to start glow discharge, thereby generating ultraviolet rays. The fluorescent material is excited with the ultraviolet rays to emit visible light.

As the material of the cold emission electrodes, a metal element having a relatively low work function, such as nickel (Ni) or molybdenum (Mo) is used.

A cold emission discharge fluorescent tube having a cold emission electrode made of such a material has a higher luminance (cd/m$^2$) with a decrease in its tube diameter. A low-profile device having the cold emission discharge fluorescent tube can be obtained and is suitable for the backlight of a liquid crystal display device.

A cold emission discharge fluorescent tube having a cold emission electrode has a high lamp discharge voltage and hence high lamp power consumption. In particular, it is difficult to perform display operation for a long period of time when the tube is used as a backlight in a battery-driven portable display device.

An electron emitting material is sputtered from the above metal electrode by discharge, and then the sputtered electron emitting material contaminates the tube wall and shortens the emission service life.

BRIEF SUMMARY OF THE INVENTION

It is an object of the present invention to provide a cold emission electrode having a low discharge voltage and a stable discharge voltage even upon long-term use, a method of manufacturing the cold emission electrode, and a cold emission discharge fluorescent tube.

The cold emission electrode of the present invention is made of a hydride of at least one element selected from the group consisting of Sc (scandium), Y (yttrium), La (lanthanum), Ce (cerium), Gd (gadolinium), Lu (lutetium), Th (thorium), U (uranium), and Np (neptunium).

According to the present invention, cold electrons can be emitted from a hydride at a low voltage. Even if discharge occurs, the hydride can hardly be sputtered, thereby performing a stable operation for a long period of time.

The hydride may be $RH_{2+x}$ (wherein R is at least one element selected from the group consisting of Sc, Y, La, Ce, Gd, Lu, Th, U, and Np, H is hydrogen, and $-1<x<1$). The above hydride has a crystal structure unique to a material basically represented by $RH_2$. This $RH_2$ including $RH_{2+x}$ shifted from stoichiometry due to omissions or excessive presence of the element represented by R and H (hydrogen) atom. The hydride satisfies the above necessary conditions as the cold emission electrode, i.e., a low work function, a material rarely sputtered and reacted with mercury vapor, and high conductivity. Of the hydrides of the above rare earth elements or actinoid elements, the rare earth or actinoid element contains one or a plurality of elements. Yttrium is totally most suitable in consideration of cost, treatment, electron emission characteristics, and the like.

Note that the cold emission electrode may contain an oxide of at least one element selected from the group consisting of Sc, Y, La, Ce, Gd, Lu, Th, U, and Np in addition to the hydride.

When an oxide is formed in the surface of the hydrogenated electrode material, the above element is classified into the rare earth or actinoid element. The oxide of an element belonging to the rare earth element can decrease the discharge voltage when it is used as the material of the cold emission electrode.

A method of manufacturing a cold emission electrode according to the present invention comprises forming a cold emission region of a cold emission electrode by hydrogenating a metal film in an atmosphere containing hydrogen gas, the metal film containing at least one element selected from the group consisting of Sc, Y, La, Ce, Gd, Lu, Th, U, and Np.

The metal film containing the R element is hydrogenated to produce the above hydride. The cold emission electrode having the hydride can be easily formed. In this case, the thickness of the film containing at least one element selected from the group consisting of Sc, Y, La, Ce, Gd, Lu, Th, U, and Np before hydrogenation is preferably set to be less than 13,000 Å.

When the thickness of the metal film is set to be less than 13,000 Å, the following effect can be obtained. When the above metal film is hydrogenated, hydrogen atoms enter into the metal film to form the cold emission electrode of the above hydride. When the cold emission electrode is used for a long period of time exceeding the service life as the cold cathode of the cold emission discharge fluorescent tube, the cold emission electrode is damaged by discharge or the like to discharge hydrogen in the cold emission discharge fluorescent tube.

When hydrogen is discharged in the cold emission discharge fluorescent tube, the hydrogen discharged interferes with mercury vapor ionization, thereby relatively lowering the luminance of the fluorescent color of the fluorescent material owing to decrease of the ultraviolet ray emission amount. As a result, the emission color of mercury vapor is visually observed with a higher luminance to emit bluish light, resulting in inconvenience. When the concentration of hydrogen discharged in the cold emission discharge fluorescent tube increases, the tube cannot be used. When the thickness of the metal film is set to be less than 13,000 Å, the content of hydrogen contained in the metal film can be limited. Even if hydrogen is discharged in use for a long period of time, the hydrogen level can be prevented from becoming the concentration which does not allow use of the cold emission discharge fluorescent tube.

When the above metal film is hydrogenated in a manner to be described later, hydrogen can enter into the metal film in an excessive amount, the content of hydrogen contained in the hydrogenated metal film must be limited within the necessary amount in addition to the limitation of the thickness of the metal film. After hydrogenation, when excessive hydrogen is discharged in advance by heating the metal film at a reduced pressure, the thickness of the metal film may be 13,000 Å or more.

The cold emission electrode of the present invention is obtained by forming an electron emitting layer containing the hydride of the R element on a conductive substrate. The electron emitting layer may have a metal layer made of an element represented by R described above and a hydrogenated layer made of the hydride of R and formed on the metal layer.

With the above structure, the element represented by R, i.e., the metal of an element included in the rare earth or actinoid element is suitable as a cold cathode except that it can react with mercury vapor. The element represented by R exhibits conductivity as a metal. When the electron emitting layer has a metal layer and a hydrogenated layer formed on the metal layer, the metal layer is coated with the hydrogenated layer which does not react with mercury vapor, thereby preventing the metal layer from reacting with mercury vapor. In addition, the metal layer serves as a conductor connected to the hydrogenated layer. In forming the electron emitting layer, for example, the metal film is formed on a conductive substrate and then hydrogenated. In hydrogenating the metal film, when the content of hydrogen contained in the metal film is limited due to the above reason, the exposed surface side of the metal film is hydrogenated first, and then part of the metal film on the substrate side is not hydrogenated. The hydrogenated layer is left on the metal layer. Even in this case, the electrode can function as a good cold emission electrode.

The hydride film may be formed as the electron emitting layer on the substrate. Alternatively, the metal layer and hydrogenated layer may be sequentially formed on the substrate. The substrate may be a conductive or semiconductor substrate. For example, a metal substrate is formed in a suitable electrode shape, e.g., in the shape of a plate or needle. An electron emitting layer made of the above hydride is formed on this substrate, and a wire is connected to the metal substrate, thereby relatively easily manufacturing the electrode.

When a metal substrate is made of the same material (e.g., a nickel electrode) as the metal electrode conventionally used as a cold cathode, the metal substrate itself functions like the conventional metal electrode in long-term use exceeding the service life of the electron emitting layer even if the electron emitting layer is damaged in an unusable state. A phenomenon in which the cold emission electrode does not function suddenly will not occur although the discharge voltage increases.

For example, when this cold emission electrode is used in a cold emission discharge fluorescent tube, damage to the electron emitting layer due to long-term use exceeding the service life of the electron emitting layer does not cause sudden turn-off of the cold emission discharge fluorescent tube. Electrons are emitted from the metal substrate, and the cold emission discharge fluorescent tube is held in the standby state.

When the thickness of the oxide film is 2,000 Å or less, the discharge voltage can be kept low even in the presence of the oxide layer in the surface layer portion of the electron emitting layer. In addition, the cold emission discharge fluorescent tubes can be mass-produced with a high yield because the electrical characteristics of the cold emission electrode are stable.

When a metal film made of the above element is formed on the substrate and the metal film is hydrogenated in an atmosphere containing hydrogen, oxygen gas, for example, may be contained in the atmosphere as an impurity, or a compound (oxygen-containing substance) containing an oxygen element, such as water, may be contained as an impurity. In this case, the surface of the metal film may be oxidized.

In addition, in the presence of hydrogen gas, even if a very small amount of oxygen element is present in the atmosphere, permeation of the oxygen element into the above metal film is promoted to readily allow oxidation of the metal film according to the finding of the present inventors. When the metal film is hydrogenated in the atmosphere containing hydrogen in the presence of the oxygen element as an impurity, at least the surface layer portion of the metal film is oxidized with a high possibility. It is confirmed that the oxide region itself serves as a good cold emission electrode even in the presence of the oxide region in the surface layer region of the electron emitting layer.

The method of manufacturing the cold emission electrode may comprise hydrogenating the metal film in an inert gas atmosphere containing hydrogen gas in an amount of 10 ppm or more to 0.5 vol % or less and rare gas.

With the above method, when the hydrogen concentration in hydrogenating the metal film is set to be 0.5 vol % or less, excessive hydrogen can be prevented from entering into the metal film, and an adverse influence caused by the discharge of hydrogen from the cold emission electrode can be prevented.

When the above metal film is heated at a temperature range of 300° C. to 650° C., the film of the metal represented by R can be hydrogenated within a short time. When the heating temperature is less than 300° C., it is difficult to quickly hydrogenate a metal film made of at least one element selected from the group consisting of Sc, Y, La, Ce, Gd, Lu, Th, U, and Np. A hydride cannot be produced in an amount enough to use in practical as a cold emission electrode within a short time. When the heating temperature exceeds 650° C., oxidation of the metal film of the element selected from the element group is promoted even in the presence of an oxygen element in a very small amount as an impurity in the form of water or oxygen molecules in the atmosphere. It is often difficult to hydrogenate the above metal film. That is, in the coexistence of hydrogen and oxygen, when a rare earth element including the above element or an actinoid metal is heated, permeation of the oxygen element into the above metal is promoted, and the metal is readily oxidized even at a very low oxygen concentration. When the heating temperature exceeds 650° C., the metal is oxidized with a high possibility even in the presence of oxygen at a predetermined impurity concentration. The heating temperature is preferably set to 650° C. or less. Even at 650° C. or less, an oxide film is slightly formed on the surface of the above metal film, but the metal film is simultaneously hydrogenated. Therefore, a hydride necessary in practice can be obtained.

A cold emission tube according to the present invention comprises a cold emission electrode containing a hydride of at least one element selected from the group consisting of Sc, Y, La, Ce, Gd, Lu, Th, U, and Np.

An electron emitting electrode containing a hydride having a low work function can emit cold electrons at a low voltage, and good discharge can stabilize.

A liquid crystal display device according to the present invention comprises a cold cathode discharge lamp for emitting light, having a pair of electron emitting electrodes provided in the fluorescent tube, opposing each other, each comprising an electron emitting film containing a hydride of at least one element selected from the group consisting of Sc, Y, La, Ce, Gd, Lu, Th, U, and Np. In a transmission liquid crystal display device having a backlight which consumes most of the power of the device, when the liquid crystal device is a portable battery-driven liquid crystal device, the necessary power consumption of the backlight can be reduced with the use of the cold cathode discharge lamp. The operation time in use of the battery of the portable electronic device can increase. At the same time, the discharge voltage is stable for a long period of time, and power consumption will not increase with the long-term use.

A plasma display panel requiring a high discharge voltage for plasma display comprises an electrode having an electron emitting film containing a hydride of at least one element selected from the group consisting of Sc, Y, La, Ce, Gd, Lu, Th, U, and Np. Therefore, the plasma display panel can perform display operation at a low voltage.

A display device for performing display operation by field emission according to the present invention comprises an electrode having an electron emitting film containing a hydride of at least one element selected from the group consisting of Sc, Y, La, Ce, Gd, Lu, Th, U, and Np. Field emission can be performed at a low voltage in long-term use.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Cold emission electrodes, methods of manufacturing the same, cold emission discharging fluorescent tubes using the same, cold emission discharging display devices, and cold emission display devices of the embodiments of the present invention will be described below.

In the embodiments, a hydrogenated compound $RH_{2+x}$ (wherein R is at least one element selected from the group consisting of Sc, Y, La, Ce, Gd, Lu, Th, U, and Np, and H is hydrogen) is applied as an electron emitting material for a cold emission electrode. An example is yttrium hydride. To examine the physical properties of yttrium hydride, an yttrium film (containing a very small amount of hydrogen) substantially made of yttrium element is formed on a silica glass substrate to a thickness of 1,000 Å to 13,000 Å and heated in an argon (Ar) gas atmosphere containing hydrogen gas in the range of several ppm to 100 vol %, or substantially pure hydrogen gas, at about 300° C. to 650° C. to hydrogenate the yttrium film.

Figure 1:
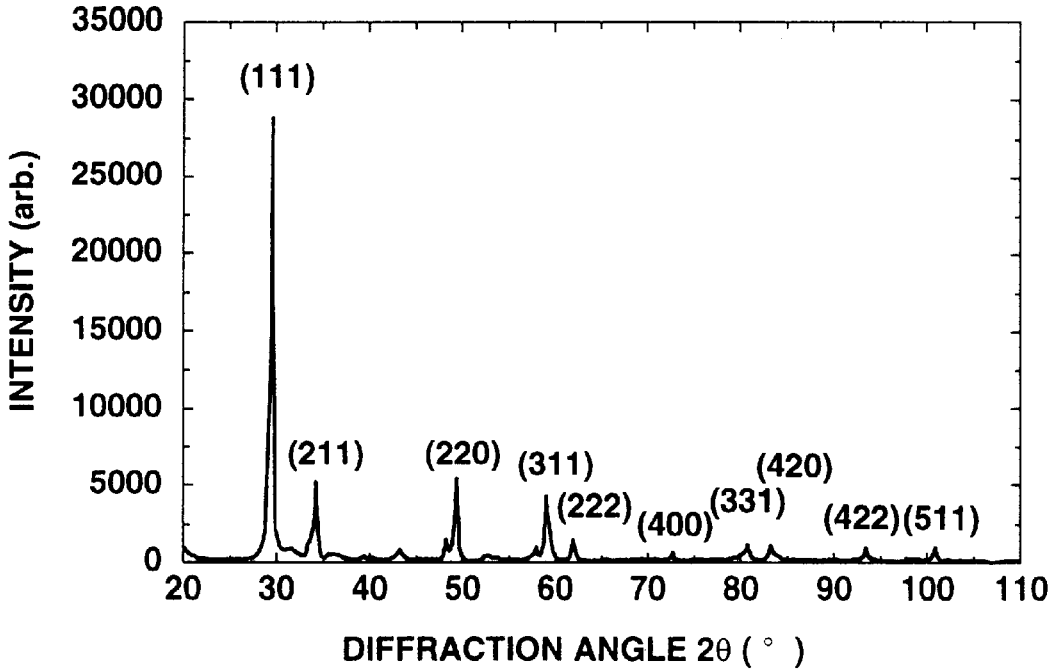
FIG. 1 is a graph showing the X-ray diffraction pattern of yttrium hydride used as an electrode material of the present invention.

FIG. 1 shows the X-ray diffraction result of the yttrium hydride film obtained in the above hydrogenation process. This diffraction pattern allows to identify that a substance formed on a glass substrate is uniform yttrium hydride in which yttrium atoms are arranged in the face-centered cubic lattice in the presence of hydrogen atoms.

Figure 2:
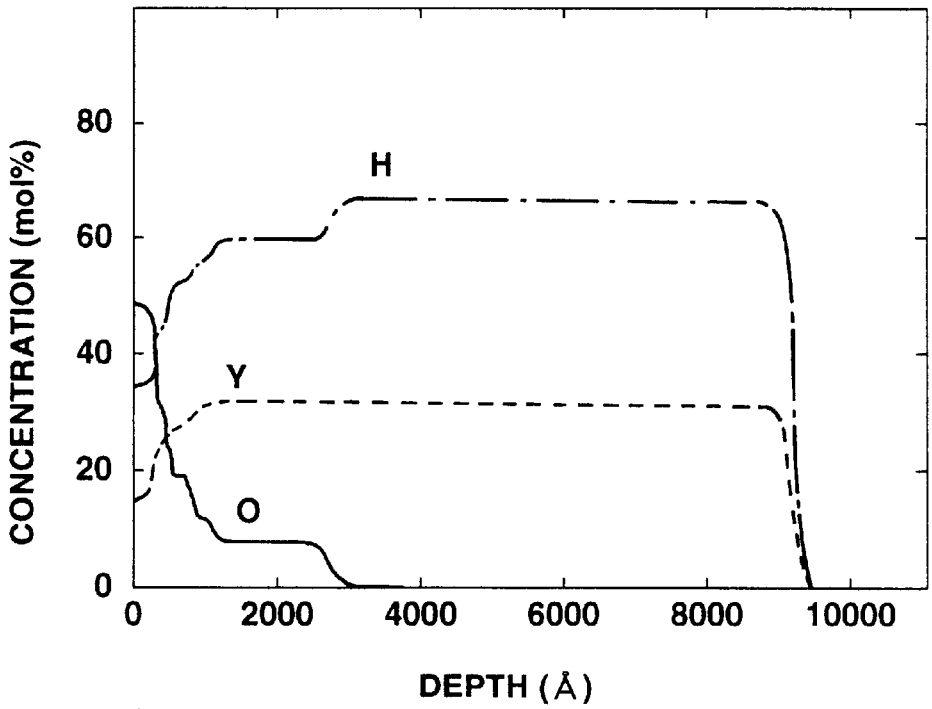
FIG. 2 is a graph showing the element components of yttrium hydride used as the electrode material of the present invention.

FIG. 2 is a graph showing the element components of yttrium hydride analyzed by Hydrogen forward scattering (HFS) spectroscopy in the direction of thickness. The broken line indicates yttrium atoms; the chain line, hydrogen atoms; and the solid line, oxygen atoms. A thin oxide region is formed at the surface of this film. It is found that an initial discharge voltage slightly lowers in the absence of the oxide region on the surface, as will be described in detail later. As can be apparent from FIG. 2, a molar ratio of hydrogen to yttrium is about 2:1, and the chemical formula of the yttrium hydride obtained upon confirming the absence of other elements is basically $YH_2$.

Yttrium having a thickness of 4,000 Å was formed on a silica glass substrate in an argon atmosphere containing a hydrogen partial pressure of 500 ppm, and the yttrium was heated at 400° C. to form yttrium hydride. The reflectivity and transmittance of the resultant yttrium hydride were measured, and the reflectivity and transmittance measurement results are shown in FIGS. 3 and 4, respectively.

Figure 3:
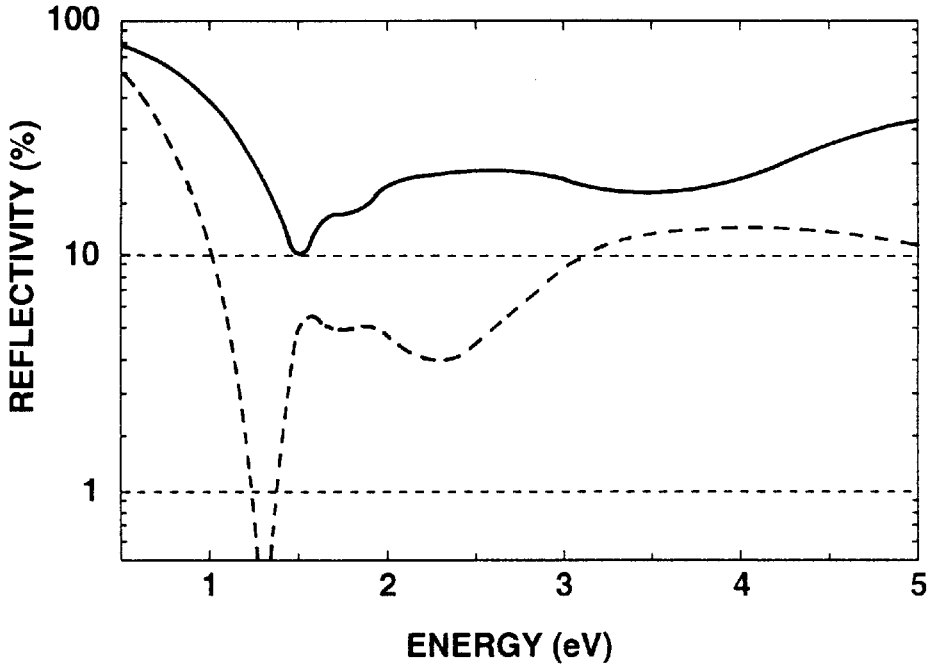
FIG. 3 is a graph showing reflectivities of glass and yttrium hydride used as the electrode material of the present invention.

Referring to FIG. 3, the broken line indicates substantially the reflectivity of yttrium hydride irradiated with light from the yttrium hydride film side; the solid line, the sum of reflectivity of silica glass substrate irradiated with light from the silica glass substrate side and the reflectivity of yttrium hydride film which reflects light transmitted through the glass substrate.

From the measurement results of reflectivities shown in FIG. 3, the reflectivity of the yttrium hydride film abruptly decreases from 0.5 eV to 1.5 eV at the yttrium hydride surface and glass surface, and then increases upon obtaining a minimum value. The reflectivity from the peak energy to the high-energy side of 5 eV or less is smaller than that at the energy of 0 eV. In normal yttrium metal, the reflectivity does not abruptly drop at the glass surface. The yttrium has been hydrogenated up to yttrium contacting the glass substrate, as can be apparent from FIGS. 2 and 3.

Figure 4:
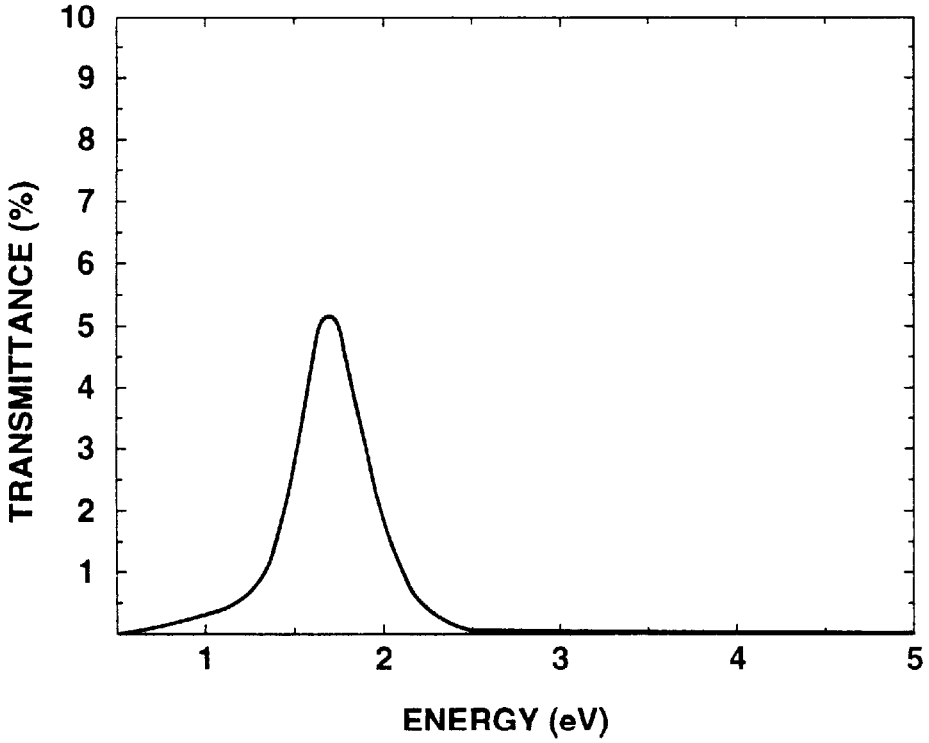
FIG. 4 is a graph showing the transmittance of yttrium hydride used as the electrode material.

Judging from the transmittance measurement result in FIG. 4, the bandpath serving as the transmittance peak is observed near 1.8 eV. Note that 1 eV corresponds to 1,250 nm in light wavelength.

The following assumptions can be derived from these optical data.

Assumption 1. The minimum value of the reflectivity is a plasma edge.

Assumption 2. Of all the transmittance data, the energy side lower than 1.8 eV has a lower transmittance because light is reflected. The energy side higher than 1.8 eV has a low transmittance due to absorption caused by transition from valence band to conduction band.

A carrier concentration calculated from the energy at the plasma edge is about 1/10 that of a normal metal. The resistivity of the yttrium film formed on the silica glass substrate as described above is actually measured as 0.09 mΩ/cm, which is found to exhibit conductivity.

The yttrium hydride thus produced can be estimated as a film in which the conductive composition formula $YH_2$ and the semiconductor composition formula $YH_3$ are present at a given ratio. The ratio depends on the hydrogen concentration and the like in hydrogenation. Judging from neutron diffraction, hydrogen is located at the center (tetracoordination) of the tetrahedral site of Y or the center (octacoordination) of the octahedral site of Y.

Since only hydrogen at the center (tetracoordination) of the tetrahedral site of Y is supposed to produce yttrium hydride, hydrogen can have a considerably wide solid-solution range (i.e., a range of hydrogen with respect to Y) while the crystal structure is kept unchanged. Yttrium hydride may have the composition ratio YH as an assumption. Therefore, yttrium hydride here basically has the $YH_2$ crystal structure including substances in which the ratio of yttrium and hydrogen shifts from 1:2. Yttrium hydride is actually defined as $YH_{2+x}$ ($-1<x<1$).

The electrode material is not limited to the hydride of yttrium of all rare earth elements, but can be a hydride of one element selected from the group consisting of other rare earth elements (including actinoids), i.e., Sc, La, Ce, Gd, Lu, Th, U, and Np.

The electrode material may contain a hydride of a plurality of elements selected from the group consisting of Sc, Y, La, Ce, Gd, Lu, Th, U, and Np.

An example of the electrode material, therefore, is represented by $RH_{2+x}$ (wherein R is at least one element selected from the group consisting of Sc, Y, La, Ce, Gd, Lu, Th, U, and Np, H is hydrogen, and $-1<x<1$).

The hydride of the element represented by R basically exhibits conductive or semiconductor properties as yttrium hydride and can be used for a cold emission electrode.

The electrode material represented by $RH_{2+x}$ can have a crystal structure derived from a substance basically represented by $RH_2$ even if the ratio of R and H shifts from 1:2.

A cold emission electrode made of the above electrode material will be described below.

Figure 5:
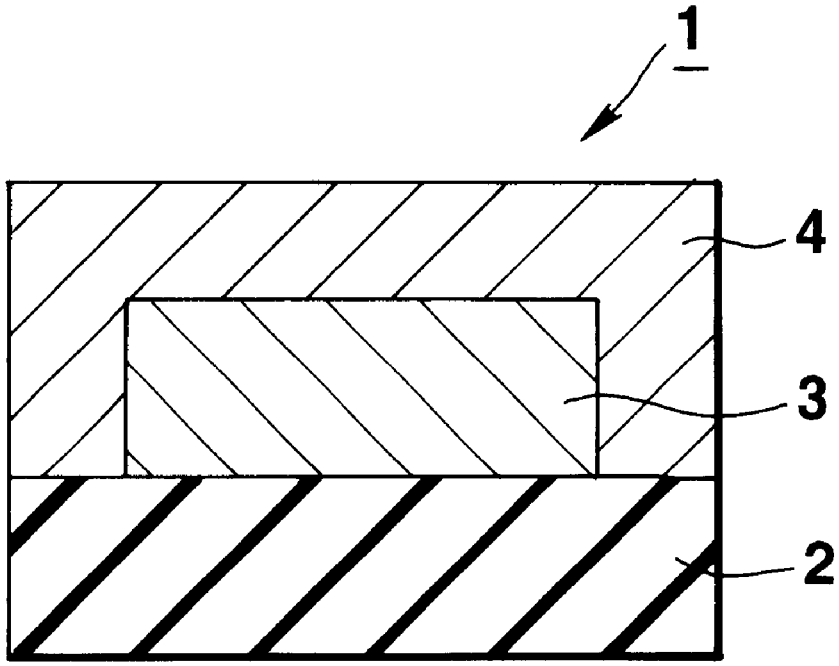
FIG. 5 is a sectional view showing an embodiment of a cold emission electrode according to the present invention.
Figure 6:
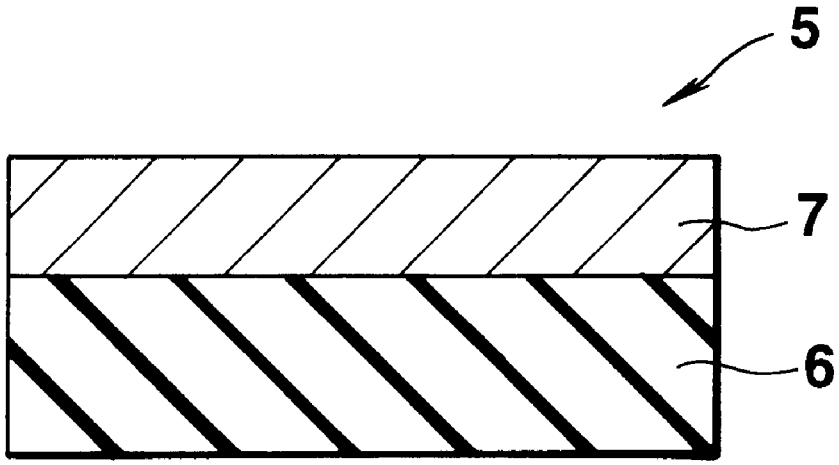
FIG. 6 is a sectional view showing another embodiment of a cold emission electrode according to the present invention.

As shown in FIG. 5, as an example of a cold emission electrode 1, an yttrium film 3 is formed on a metal substrate 2 made of or containing, e.g., nickel or nickel-chromium. An yttrium hydride film 4 is formed to cover the yttrium film 3. As an alternative cold emission electrode 5, as shown in FIG. 6, an yttrium hydride film 7 is formed on a metal substrate 6 made of or containing nickel or nickel-chromium.

The metal substrates 2 and 6, i.e., substrates on which the cold emission layers 4 and 7 are to be formed, exhibit conductive or semiconductor properties and are made of a single element or element mixture which can hardly be sputtered. Examples of such an element are Mo (molybdenum) and Al (aluminum) in addition to the above elements.

The yttrium hydride films 4 and 7 serving as the cold electron emitting layers contain an electrode material represented by $RH_{2+x}$ (wherein R is at least one element selected from the group consisting of Sc, Y, La, Ce, Gd, Lu, Th, U, and Np, H is hydrogen, and $-1<x<1$).

The non-hydrogenated metal film 3 shown in FIG. 5 is made of a single metal or metal mixture represented by R. This metal is basically a conductor having a low work function and is suitable as the material for the cold emission electrode unless it reacts with mercury vapor. This non-hydrogenated metal layer may be made of not a single metal element, but an R-containing compound if it is readily hydrogenated.

Since the non-hydrogenated metal film is covered with the metallic hydride layer, the metal film is not brought into direct contact with mercury vapor and can hardly react with mercury vapor even if the discharge atmosphere contains mercury vapor.

The cold emission layers 4 and 7 are made of the electrode material described above and have low discharge voltages (to be described in detail later) and exhibit long-term stability because the discharge voltages rarely rise in long-term use.

In hydrogenating a metal film made of an element represented by R, a thin oxide region is formed in the cold emission layers 4 and 7 in the presence of a very small amount of oxygen or oxygen-containing substance. The oxide region, which is mixed with hydride region at the surface of the cold emission layers 4 and 7, preferably removed because the discharge voltage slightly decreases with the exposed metallic hydride layer.

In spite of the above fact, yttrium oxide is basically suitable as the material for the cold emission electrode except stability. In the coexistence of hydrogen, when the above metal film is oxidized, permeation of oxygen into the metal film tends to be promoted by hydrogen. The resultant structure contains both yttrium hydride and yttrium oxide.

In either case, the oxide region exhibits a low discharge voltage as the emitting electrode, although the decrease in discharge voltage compared with discharge voltage of nickel as a common cold emission metal is not larger than that of the exposed hydride region.

The presence of a thin oxide region does not extremely adversely affect the initial discharge performance of the cold emission electrode. More specifically, when the thickness of the oxide region is 2,000 Å or less, the oxide region is sputtered over time by discharge to expose the hydride region. As far as long-term stable discharge is possible, the hydride electrode with the thin oxide region is substantially equivalent to a hydride electrode without a thin oxide region.

The cold emission electrode applied to the above cold emission tube will be described below.

Figure 7:
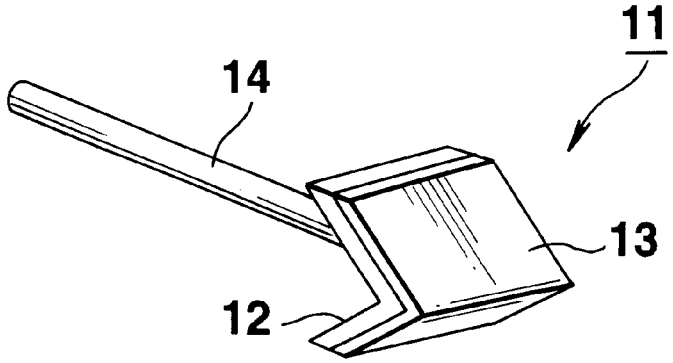
FIG. 7 is a perspective view showing still another embodiment of a cold emission electrode according to the present invention.

As shown in FIG. 7, this cold emission electrode 11 comprises a wedge-shaped or V-shaped substrate 12 and a cold emission layer 13 containing yttrium hydride and formed on one surface of the substrate 12 to a thickness of 500 Å to 30,000 Å. The substrate 12 is connected to a wire 14. The cold emission layer 13 may contain yttrium oxide. The metal substrate 12 and the wire 14 are made of a single element selected from, e.g., Ni, Cr, Mo, Al, Ti, Nd, Cu, Ag, and Au, or their alloy. The substrate 12 and the cold emission layer 13 may be formed by bending the substrate 12 upon forming the yttrium hydride film on the surface of the flat substrate. Alternatively, the yttrium hydride film may be formed on the wedge-shaped substrate 12.

Figure 8:
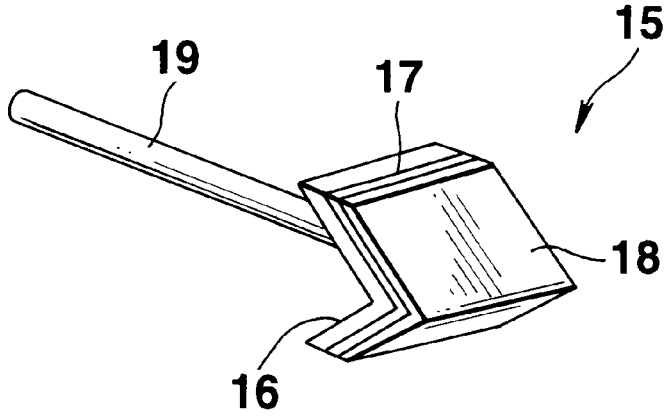
FIG. 8 is a perspective view showing still another embodiment of a cold emission electrode according to the present invention.

Another cold emission electrode applied to the cold emission tube is shown in FIG. 8. A metal film 17 containing at least one element selected from the group consisting of Sc, Y, La, Ce, Gd, Lu, Th, U, and Np is formed on a substrate 16, and an electron emitting film 18 containing a hydride of at least one element selected from the group consisting of Sc, Y, La, Ce, Gd, Lu, Th, U, and Np is formed on the metal film 17. A wire 19 is connected to the substrate 16.

Figure 9:
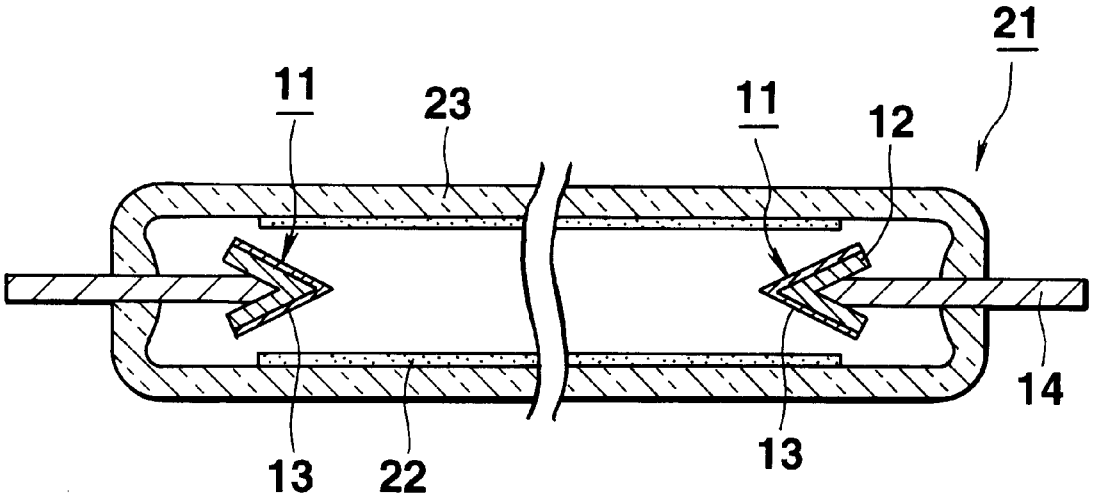
FIG. 9 is a sectional view showing an embodiment of a cold emission discharge fluorescent tube having a cold emission electrode.
Figure 10:
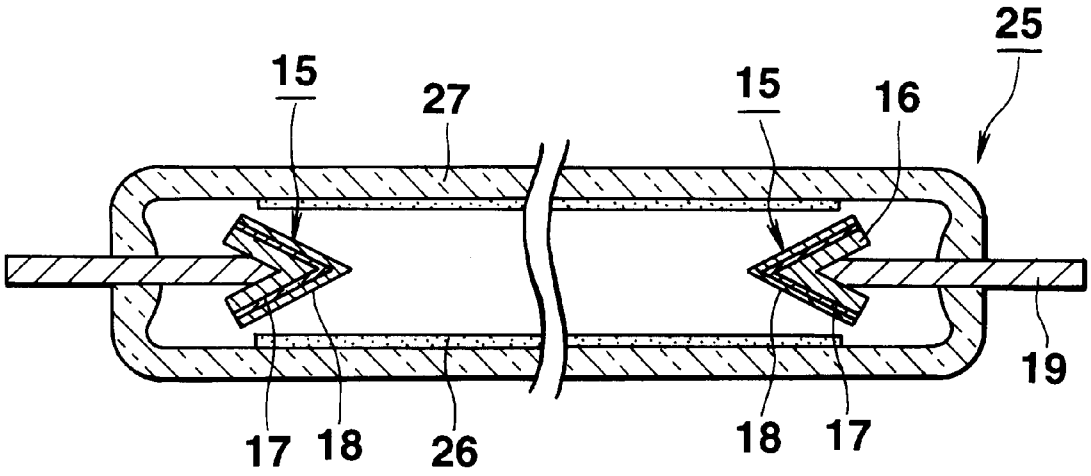
FIG. 10 is a sectional view showing another embodiment of a cold emission discharge fluorescent tube having a cold emission electrode.

A straight cold emission discharge tube 21 using this cold emission electrode 11 is shown in FIG. 9. The cold emission discharge fluorescent tube 21 has the following structure. That is, the inner wall of a transparent glass tube 23 is coated with a fluorescent material 22 for emitting light in a predetermined wavelength range in an excited state. The pair of cold emission electrodes 11 are disposed to oppose the cold emission layer 13. A rare gas (e.g., argon) and mercury are sealed in the glass tube 23. Alternatively, as shown in FIG. 10, a cold emission discharge fluorescent tube 25 having a pair of cold emission electrodes 15 in a transparent glass tube 27 whose inner wall is coated with a fluorescent material 26 may be used.

A method of manufacturing the cold emission electrode will be described with reference to FIGS. 11 and 12.

In an example of the manufacture of the cold emission electrode, the cold emission electrode is manufactured by the film formation step of forming a film of a metal (at least one element selected from the group consisting of Sc, Y, La, Ce, Gd, Lu, Th, U, and Np) represented by R on a substrate, and the hydrogenation step of hydrogenating the metal film by heating the metal film in an atmosphere containing hydrogen gas.

In the film formation step, a substrate 333 made of a nickel-chromium-based material is cleaned, and an yttrium film 334 is formed on the surface of the substrate 333 by deposition or sputtering with resistance heating or an electron beam. The yttrium film 334 readily tends to be oxidized. Once the yttrium film 334 is oxidized, it is difficult to hydrogenate it. The yttrium film 334 is held not to be brought into contact with oxygen until the hydrogenation step. The substrate 333 is made of a material equivalent to the material of the conventional nickel electrode. Even if the electron emitting layer is sputtered in the use for a long period of time exceeding the service life of the cold emission layer containing yttrium, and the electron emitting layer becomes almost absent, the substrate serves as the nickel electrode. The cold emission electrode will not abruptly stop functioning in use exceeding the service life of the electron emitting layer, although the discharge voltage increases to the same level as that of the conventional electrode.

In a cold emission discharge fluorescent tube manufactured by only the electrode/substrate cleaning step, the yttrium film formation step of forming a thick yttrium film, the hydrogenation step, and absence of dehydrogenation step when the discharge time exceeds 100 hrs, white emission becomes bluish because excessive hydrogen is discharged from yttrium hydride in the discharge fluorescent tube. In hydrogenating the yttrium metal film, the excessive hydrogen enters into the metal film 334 with a high possibility. The thickness of the metal film 334 before hydrogenation, which is formed in the film formation step, is preferably less than 13,000 Å. In particular, when the thickness is 6,000 Å or less, the manufacture can be easily controlled with small variations in discharge characteristics even in the presence of slight differences in hydrogen partial pressure (hydrogen concentration) in the hydrogenation step. The most preferable thickness is about 4,000 Å because the variations are the smallest. When the thickness of the metal film 334 is set to, e.g., 13,000 Å or more, a large amount of hydrogen is discharged (exhausted) from the cold emission electrode manufactured by hydrogenating the metal film 334, depending on the hydrogenation temperatures. When this cold emission electrode is used in the cold emission discharge fluorescent tube, emission of the cold emission discharge fluorescent tube may be adversely affected.

Similarly, when the cold emission discharge fluorescent tube using the cold emission electrode with the metal film 334 having a thickness of 13,000 Å or more is used for a long period of time exceeding the service life of the cold emission electrode, the cold emission electrode is sputtered. In this case, when the concentration of hydrogen discharged from the damaged electron emitting layer increases, the cold emission discharge fluorescent tube cannot be satisfactorily used at this time even if the substrate is used equivalently to the nickel electrode. If the thickness of the metal film is less than 13,000 Å, the concentration of hydrogen discharged by damage to the electron emitting layer due to electric discharge can be suppressed low. Even if the cold emission electrode is sputtered, the emergent state in which the cold emission discharge fluorescent tube cannot be abruptly used can be prevented. Note that when yttrium hydride is heated to about 700° C. at a reduced pressure after the hydrogenation step, a sufficient amount of hydrogen is discharged, even if an yttrium metal layer is over 13,000 Å in thickness, thereby satisfactorily using the electrode as the cold element emitting electrode.

Figure 11:
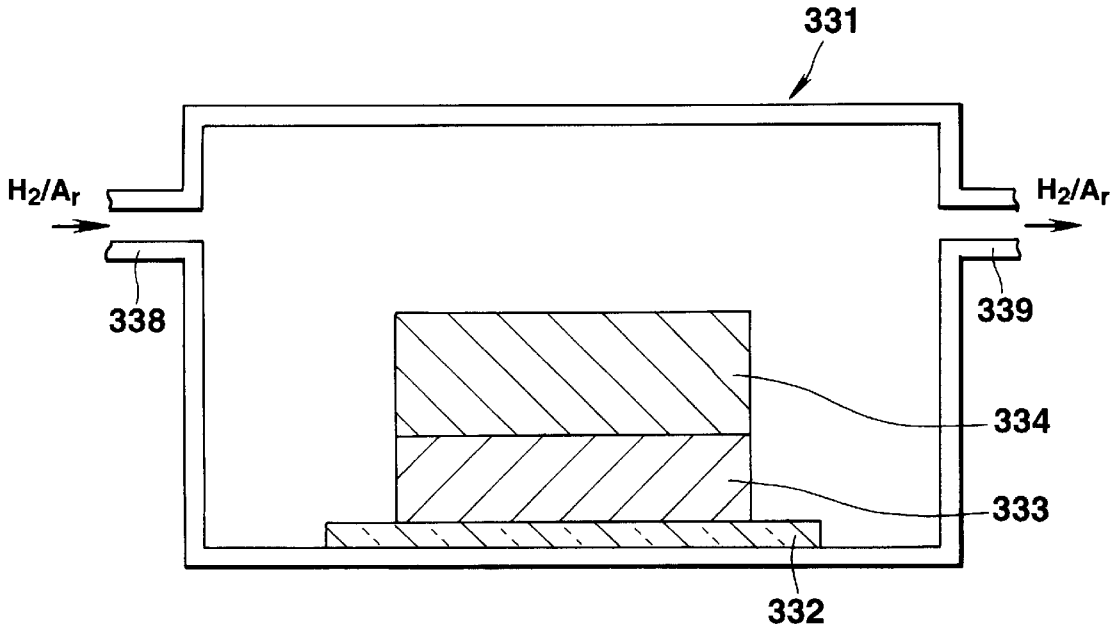
FIG. 11 is a schematic sectional view showing a step in manufacturing a cold emission electrode of the present invention.
Figure 12:
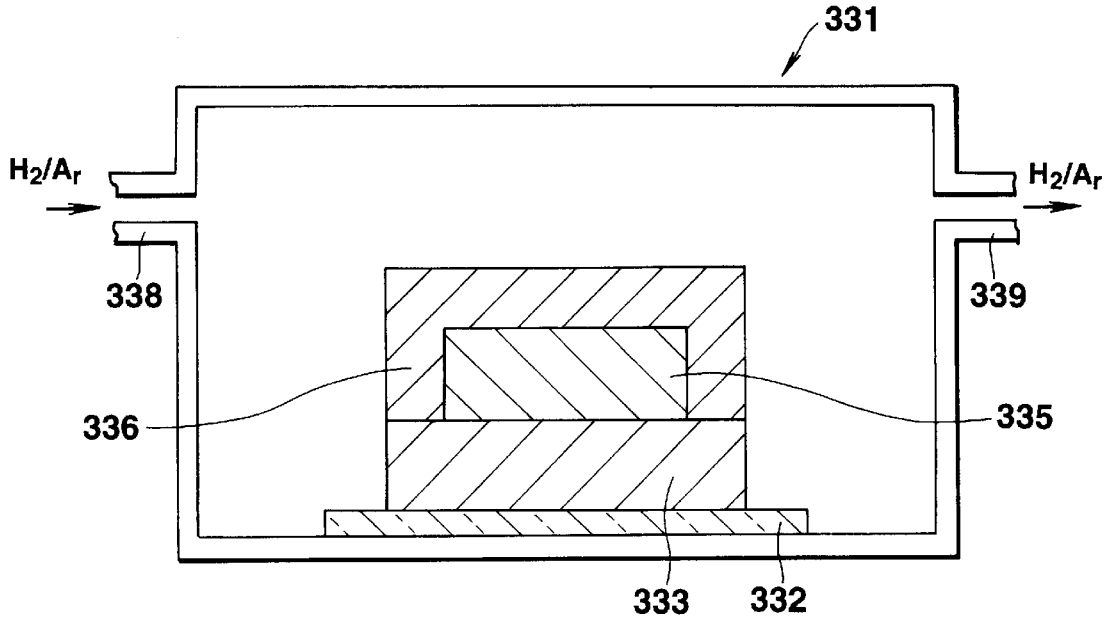
FIG. 12 is a schematic sectional view showing the hydrogenation step in the method of manufacturing the cold emission electrode of the present invention.

As shown in FIG. 11, the metal film 334 formed on the substrate 333 is transferred onto a table 332 in a reaction furnace 331. Hydrogen and argon gases are injected from a gas injection port 338 of the reaction furnace 331 so as to always fill the reaction furnace 331 with inert argon gas containing hydrogen at a predetermined concentration. The hydrogen and argon gases are exhausted from a gas exhaust port 339.

Heating is performed from room temperature to a temperature range of about 300° C. to 650° C. at a rate of 100° C./15 min to 100° C./5 min. Hydrogenation of the yttrium 334 progresses, and an yttrium hydride film 336 is gradually formed on the yttrium film 335, as shown in FIG. 12. When the heating time is extended, the remaining yttrium film 335 is entirely changed into yttrium hydride.

In the subsequent dehydrogenation step, the resultant structure is heated in a reduced pressure atmosphere of $1\times10^{-3}$ Torr or less, and preferably $1\times10^{-6}$ Torr or less at a temperature of 350° C., and preferably 450° C. to 800° C. for 15 min, thereby removing the excessive hydrogen contained in the yttrium hydride film.

Figure 13:
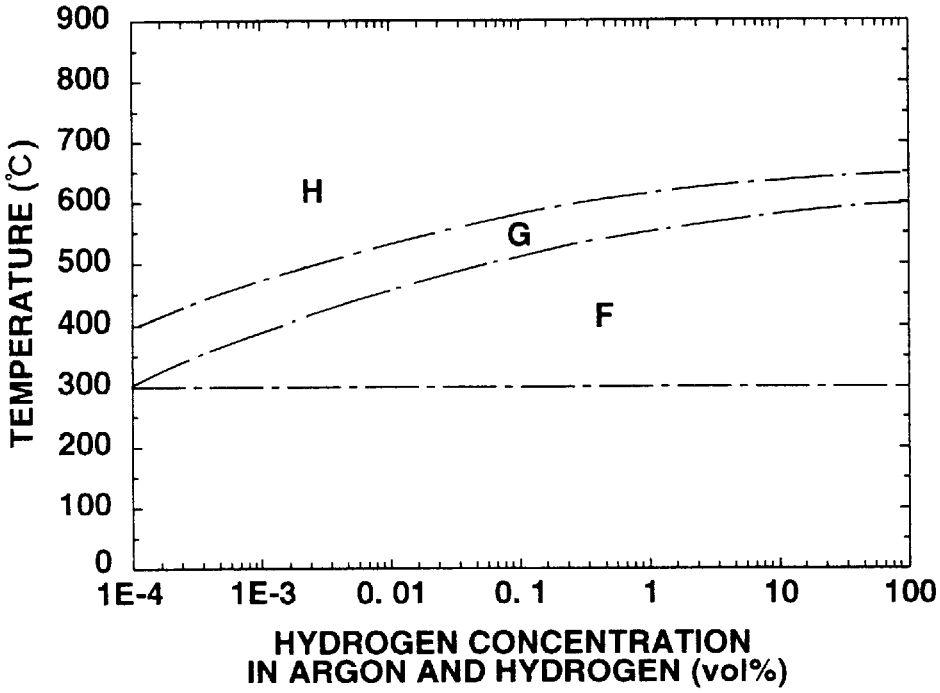
FIG. 13 is a graph showing the hydrogen concentration range and heating temperature range in the hydrogenation step in the manufacture of the above cold emission electrode.

FIG. 13 is a graph showing the ranges of hydrogen concentrations (hydrogen partial pressures) and hydrogenation temperatures in the argon and hydrogen atmosphere in the hydrogenation step of the yttrium film. A very small amount of oxygen is present in the reaction furnace.

A region F is a range in which yttrium hydride is mainly formed; G, a range in which yttrium hydride and/or yttrium oxide is formed; and H, a range in which yttrium oxide is mainly formed. Yttrium oxide is formed in a body-centered cubic lattice or simple cubic lattice depending on conditions. The yttrium compound to be produced is the one produced in about several ten minutes. The yttrium compound can be produced at lower temperatures when the yttrium film is held for a longer period of time.

A metal element represented by R may not be completely hydrogenated within a short period of time in an atmosphere having a hydrogen gas concentration of less than 10 ppm. To satisfactorily hydrogenate the metal, the hydrogen gas concentration is preferably 50 ppm or more.

For the metal represented by R, it is confirmed by X-ray diffraction that a hydrogen compound (yttrium hydride) is produced in hydrogenating Y metal under atmosphere of 100 vol % of hydrogen ($H_2$) gas. However, hydrogen may enter into an unstable position except tetracoordination or octacoordination of Y. Hydrogen in this solid-solution component is discharged over time. It is confirmed that the amount of hydrogen discharged from an yttrium hydride film in the dehydrogenation step after the hydrogenation step greatly changes in accordance with hydrogen concentration and hydrogenation temperature in the hydrogenation step.

The characteristics of the cold emission electrode and the cold emission discharge fluorescent tube will be described in detail below.

A Y metal film (thickness: about 1.3 $\mu$m) was formed on a substrate (INCONEL601) made of a nickel-chromium-based material and cleaned in advance. The metal film was hydrogenated, and the resultant metallic hydride film was heated in a vacuum furnace to discharge hydrogen mixed in the metal film in hydrogenation. The amount of discharged hydrogen gas was detected.

In the hydrogenation step, an atmosphere obtained by adding hydrogen gas to argon gas was used, and hydrogenation was performed at hydrogen gas concentrations of 500 ppm and 100 ppm.

Figure 14:
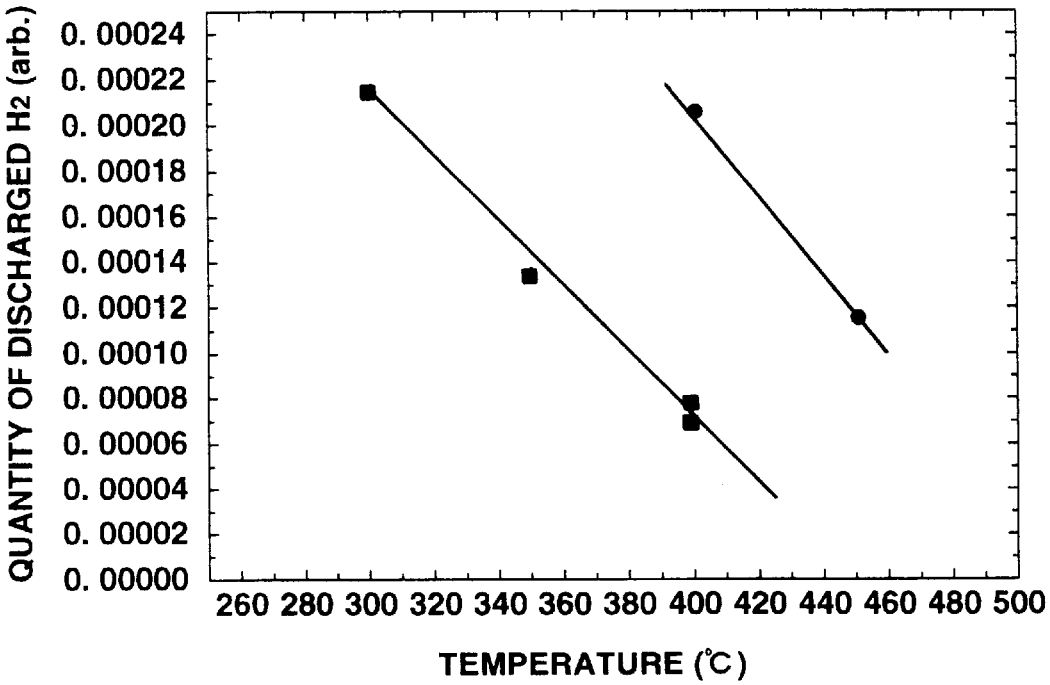
FIG. 14 is a graph showing the amount of hydrogen discharged upon heating at a predetermined temperature and a reduced pressure after the hydrogenation step of the manufacture of the above cold emission electrode.

The hydrogenation result at the temperatures (furnace temperatures) of 300° C., 350° C., 400° C., and 450° C. in the hydrogenation step is shown in FIG. 14. The abscissa represents the temperature in the hydrogenation step, and the ordinate represents the relative value of the amount of hydrogen discharged from the yttrium hydride heated after hydrogenation.

In FIG. 14, a mark ■ represents the amount of hydrogen gas discharged from the yttrium hydride film in the dehydrogenation step when the atmosphere in the furnace during the hydrogenation step is filled with argon gas containing 100 ppm of hydrogen; and ●, the amount of hydrogen gas discharged from the yttrium hydride film in the dehydrogenation step when the atmosphere in the furnace during the hydrogenation step is filled with argon gas containing 500 ppm of hydrogen.

When the hydrogen gas concentration in the hydrogenation step increases from 100 ppm to 500 ppm while the hydrogenation temperature is kept unchanged, the discharged hydrogen gas amount apparently increases. Within this temperature range, the higher the temperature in the hydrogenation step becomes, the smaller the gas amount discharged from the corresponding sample becomes. In the illustrated range, the hydrogen discharge amount has a linear function with the hydrogenation temperature.

A similar test was made for a sample manufactured in a hydrogenation atmosphere having a hydrogen gas concentration of 5%. The hydrogen discharge amount after hydrogenation was too large to directly use the sample as the electrode material of the cold emission discharge fluorescent tube without performing dehydrogenation.

Several cold emission electrodes each containing dehydrogenated yttrium hydride were formed at a hydrogen concentration of 5% or more in the hydrogenation step. Each sample was used as the cold cathode of a cold emission discharge fluorescent tube (FIG. 9) having a length of 63 mm and a diameter of 2.6 mm. When each cold emission discharge fluorescent tube was kept on for a long period of time at a lamp current of 5 mA, abnormal discharge occurred within several hundred hours due to unstable hydrogen except the one contained in the crystal as yttrium hydride.

More specifically, when the hydrogen partial pressure in the hydrogenation atmosphere is high, a large amount of unstable hydrogen is contained in an unstable position except the yttrium hydride crystal of the electron discharge layer formed upon hydrogenating the metal film. When a cold emission discharge fluorescent tube having a pair of cold emission electrodes containing an excessive amount of unstable hydrogen is used, hydrogen discharged from the cold emission electrode in the fluorescent tube adversely affects the discharge.

The hydrogen gas concentration in the hydrogenation atmosphere for obtaining yttrium hydride having the desired nature as the electrode of the cold emission discharge fluorescent tube is preferably 0.5 vol % or less when dehydrogenation is not performed later. The hydrogen gas concentration is more preferably 500 ppm or less, and most preferably about 50 ppm to 100 ppm. The above rare gas is an argon gas, but may be a rare gas such as neon.

Preferably, the atmosphere basically does not contain oxygen gas or oxygen-containing substance. If the rare gas to be used and the hydrogen gas concentration can be controlled, the atmosphere may contain a very small amount of oxygen or oxygen-containing substance. As described above, even if a very thin oxide region is formed on the surface of the electron emitting layer due to oxygen of impurity level, the resultant electrode can satisfactorily function as a cold emission electrode.

Figure 15:
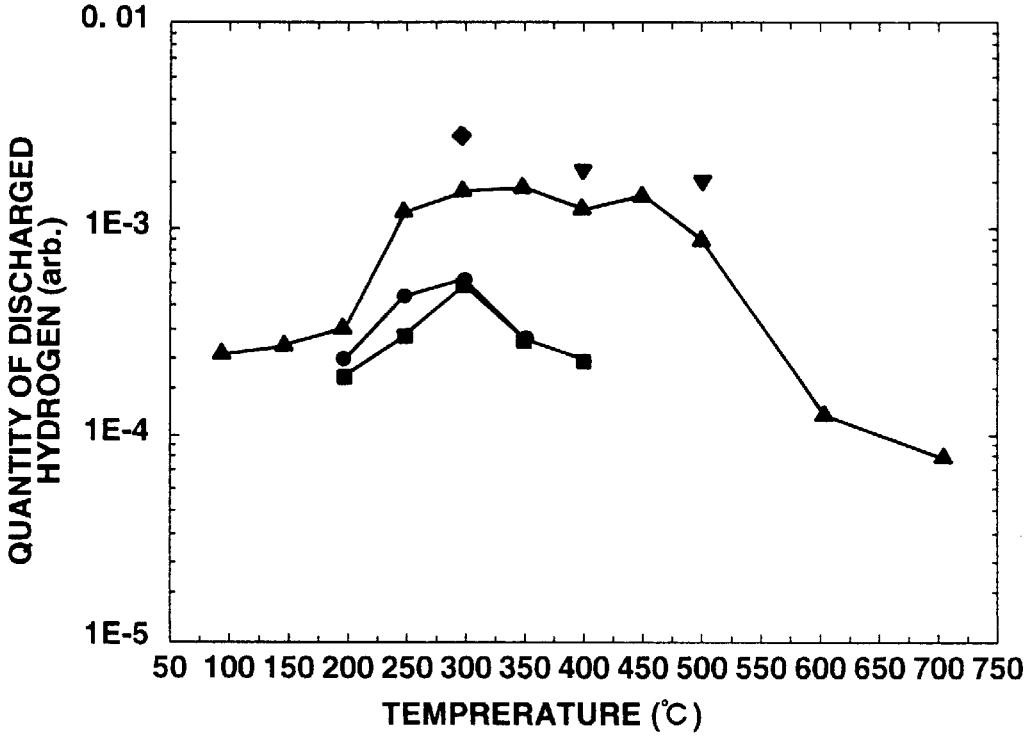
FIG. 15 is a graph showing the amount of hydrogen discharged upon heating at a predetermined temperature and a reduced pressure after hydrogenation in a wide temperature range.

FIG. 15 plots an approximate amount of hydrogen gas discharged from an yttrium hydride film and a hydrogenation temperature in order to obtain an optimal hydrogenation temperature. The abscissa represents the hydrogenation temperature, and dehydrogenation is performed for all the samples at a reduced pressure and 700° C. after hydrogenation. A furnace used here is different from that used in FIG. 14 and takes slightly different values.

FIG. 15 represents the hydrogen amount discharged upon heating yttrium hydrides at a reduced pressure and about 700° C. in the dehydrogenation after the hydrogenation operation under the various hydrogen concentrations of argon—hydrogen or hydrogen atmospheres for producing yttrium hydride. A mark ■ indicates the hydrogen concentration of 10 ppm in argon and hydrogen atmosphere; ●, 100 ppm; ▲, 500 ppm; ▼, 0.5 vol %; and ♦, 100 vol % of hydrogen. For samples whose hydrogenation temperatures were 200° C. or less, the discharged gas amounts due to temperatures were small. In many cases, yttrium hydride was not satisfactorily formed as the electrode material of the cold emission discharge fluorescent lamp in the hydrogenation step within a short time.

When hydrogenation was performed at a temperature higher than 650° C., the amount of discharged gas was small, but only yttrium oxide was often formed due to the following reason. As described above, at a hydrogenation temperature of 650° C. or more, oxidation of yttrium tends to be promoted in the presence of a very small amount of hydrogen gas. Once yttrium is oxidized, it is very difficult to obtain yttrium hydride as a final product by reducing the yttrium oxide.

A very thin yttrium oxide region (e.g., $Y_2O_3$) was formed at the surface at temperatures of less than 650° C. It was confirmed by X-ray diffraction and HFS that the thickness of the oxide region formed at the surface of yttrium hydride film was several hundred Å or less. When the thickness of the oxide region is 2,000 Å or less, the performance of the cold emission electrode does not greatly change. When yttrium is hydrogenated at a temperature of 650° C. or less, a cold emission electrode excellent in characteristics can be manufactured.

The heating temperature (temperature in the furnace) in the hydrogenation step is preferably 300° C. or more. If the heating temperature is lower than 300° C., hydrogenation of the metal represented by R is delayed, and it may be difficult to hydrogenate the metal represented by R within a short time. A more preferable heating temperature in the hydrogenation step is 350° C. or more.

When the hydrogenation temperature exceeds 650° C., the element represented by R is readily oxidized in the presence of hydrogen. The element R is oxidized in the presence of a very small amount of oxygen in the rare gas atmosphere in the hydrogenation step, as described above, and an oxide which can hardly be reduced is produced. It is, therefore, difficult to obtain a hydride of the element represented by R.

In a state wherein a very small amount of oxygen or oxygen-containing substance is present, the heating temperature in the hydrogenation step is preferably 650° C. or less, and more preferably 600° C. or less.

A temperature rise rate in heating in the hydrogenation step is preferably about 10° C./min to 30° C./min, and more preferably about 20° C./min.

A temperature fall rate after heating is preferably 10° C./min to 1° C./min, and more preferably about 3° C./min.

A cold emission electrode was manufactured using yttrium 13,000 Å thick before hydrogenation at a hydrogen concentration of about 100 ppm in hydrogenation and a heating temperature of about 400° C. in hydrogenation. A cold emission discharge fluorescent tube 21 having the shape shown in FIG. 9 and using the above cold emission electrode was kept on in a test. In this case, a glass tube 23 had an outer diameter of 2.6 mm and a length of 63.5 mm.

Figure 16:
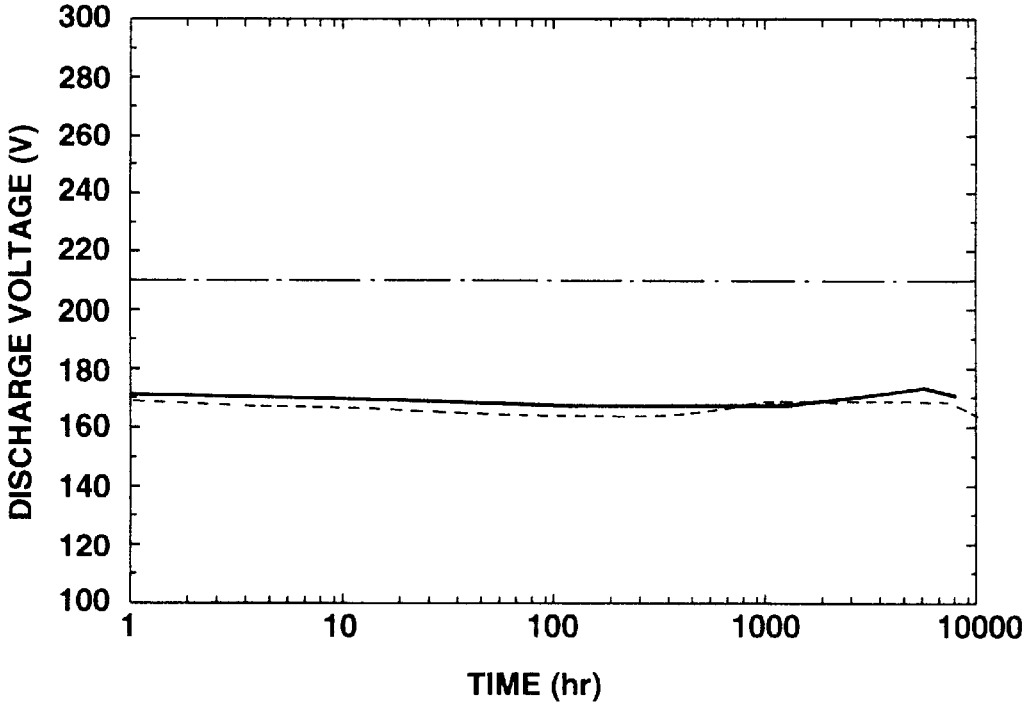
FIG. 16 is a graph showing continuous discharge characteristics of a cold emission discharge fluorescent tube using a cold emission electrode manufactured under good conditions and the discharge characteristics of a discharge tube using a nickel electrode as a comparative example.

FIG. 16 shows the discharge characteristics of the cold emission discharge fluorescent tube 21 having this yttrium hydride cold emission electrode and a discharge fluorescent tube as a comparative example having the same standard as that of a cold emission discharge fluorescent tube 20 except nickel is used for the electron emitting layer of the cold emission electrode. The sold line represents the discharge voltage characteristic of the cold emission discharge fluorescent tube 21 at 5 mA; and the broken line, at 3 mA. No increase in discharge voltage apparently appears in the yttrium hydride cold emission discharge fluorescent tube 21 even if the discharge time exceeds 7000 hrs. The dash-dotted chain line represents the discharge characteristic of the cold emission discharge fluorescent tube using the nickel electrode.

The cold emission electrode of this embodiment is improved in efficiency by about 30%, i.e., in voltage by 60 (V). That is, the cold emission electrode using yttrium hydride has a low discharge voltage and lower power consumption.

In a discharge tube having an yttrium hydride electrode on which yttrium oxide is formed, it is confirmed that the initial discharge voltage is about 170V, but with the lapse of 100 hrs, the discharge voltage lowers to about 165V due to the following reason. The oxide region formed at the surface of electron emitting layer contributes to the electron discharge characteristics in initial discharge, so that the discharge voltage is held relatively high. Upon the lapse of 100 hrs, the oxide region at the surface of electron emitting layer is sputtered, and almost the surface of the electron emitting layer consists of yttrium hydride.

Like the conventional nickel electrode, the discharge voltage of the cold emission electrode does not increase even in long-term use. The discharge voltage is stable. In addition, power consumption can be reduced as compared with the conventional nickel electrode.

In addition, a cold emission electrode was manufactured by forming an yttrium metal film about 13,000 Å thick on a nickel substrate in the film formation step and setting the hydrogen gas concentration in argon gas to 0.5 vol % in the hydrogenation step without the dehydrogenation step. A cold emission discharge fluorescent tube like the one shown in FIG. 9 was manufactured using this cold emission electrode.

Figure 17:
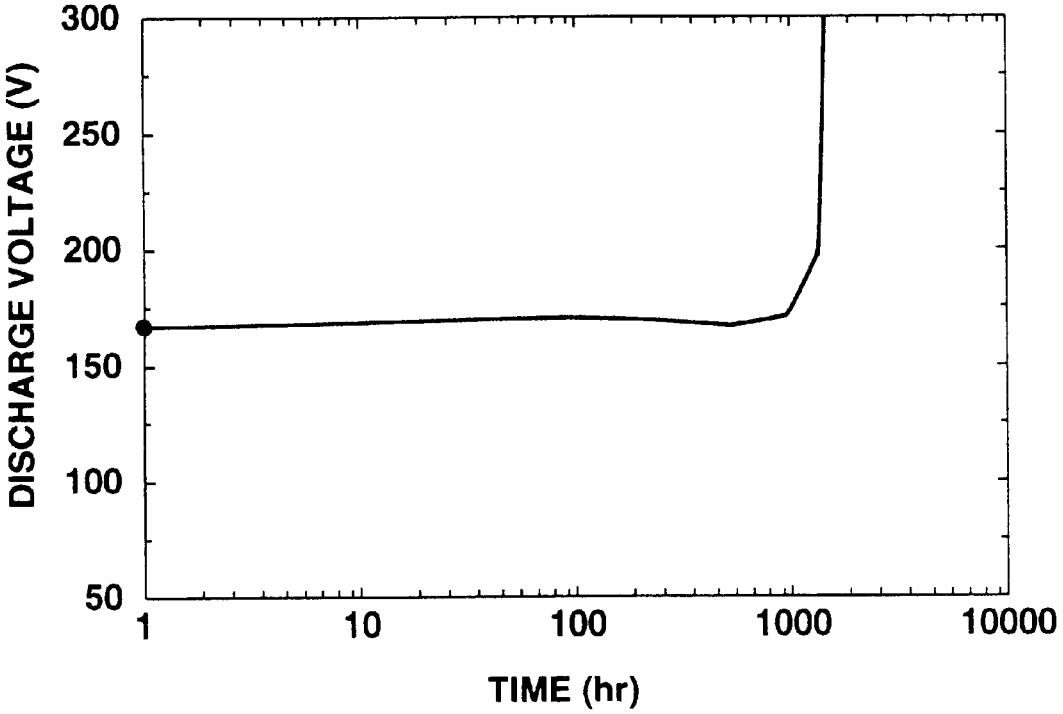
FIG. 17 is a graph showing the discharge characteristics, by an excessive current, of a cold emission discharge fluorescent tube using a cold emission electrode manufactured under not good conditions.

An excessive current life test using this cold emission discharge fluorescent tube was made. The cold emission discharge fluorescent tube was kept on at a tube current of 7 mA. The result is shown in FIG. 17. Abnormal discharge occurred when the cold emission discharge fluorescent tube was kept on for about 1,000 hrs. The tube voltage abruptly increased upon occurrence of abnormal discharge, which defined the substantial service life of the lamp and caused an increase in ambient temperature.

In the cold emission electrode used in this test, the thickness of an yttrium film before hydrogenation was as large as 1.3 $\mu$m, the hydrogen concentration in the hydrogenation step was as relatively high as 0.5 vol %, and no dehydrogenation step was performed. The amount of discharged hydrogen gas was large, and abnormal discharge occurred due to destruction of the electron emitting layer.

When the hydrogen concentration in the hydrogenation step falls within the above range, the thickness of the metal film before hydrogenation is made thin, or dehydrogenation for performing heating at a reduced pressure after hydrogenation is performed, the amount of discharged hydrogen is small even if the electron emitting layer is destroyed. Therefore, abnormal discharge can be prevented.

When abnormal discharge can be prevented upon destruction of the electron emitting layer, the nickel substrate serving as the substrate functions as a cold emission electrode even if the electron emitting layer is completely sputtered. Although the tube voltage increases to the nickel electrode level, the abrupt turn-off of the cold emission discharge fluorescent tube can be prevented upon destruction of the electron emitting layer.

Figure 18:
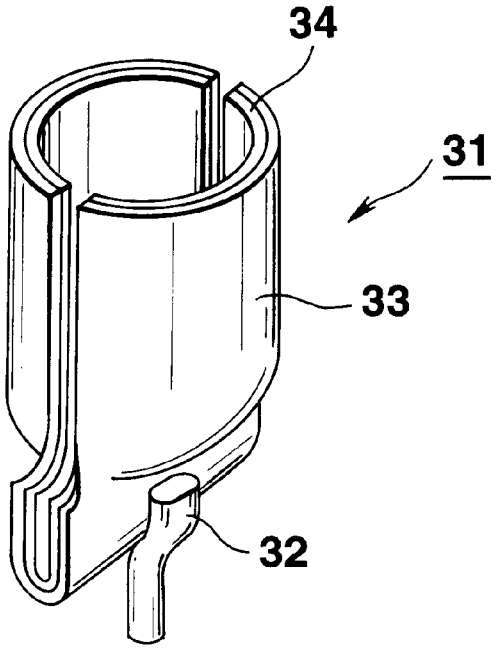
FIG. 18 is a perspective view showing the schematic structure of an embodiment of a hollow cold emission electrode according to the present invention.
Figure 19:
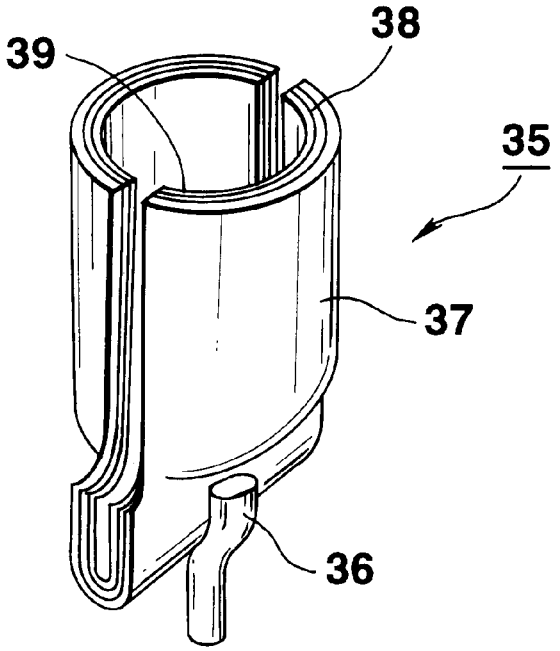
FIG. 19 is a perspective view showing the schematic structure of another embodiment of a hollow cold emission electrode according to the present invention.

A cold emission film containing an electrode material represented by $RH_{2+x}$ (wherein R is at least one element selected from the group consisting of Sc, Y, La, Ce, Gd, Lu, Th, U, and Np, H is hydrogen, and $-1<x<1$) may be applied to a hollow cold emission electrode 31, as shown in FIG. 18. The cold emission electrode 31 has a structure in which a cold emission layer 34 is formed on the inner surface of a cylindrical substrate 33 connected to a wire 32. Alternatively, as shown in FIG. 19, a cold emission electrode 35 may have a structure in which a layer 38 made of a metal or metal compound containing at least one element selected from the group consisting of Sc, Y, La, Ce, Gd, Lu, Th, U, and Np is formed on the inner surface of a cylindrical substrate 37 connected to a wire 36, and a cold emission layer 39 is formed on the surface of the metal film 38.

Figure 20:
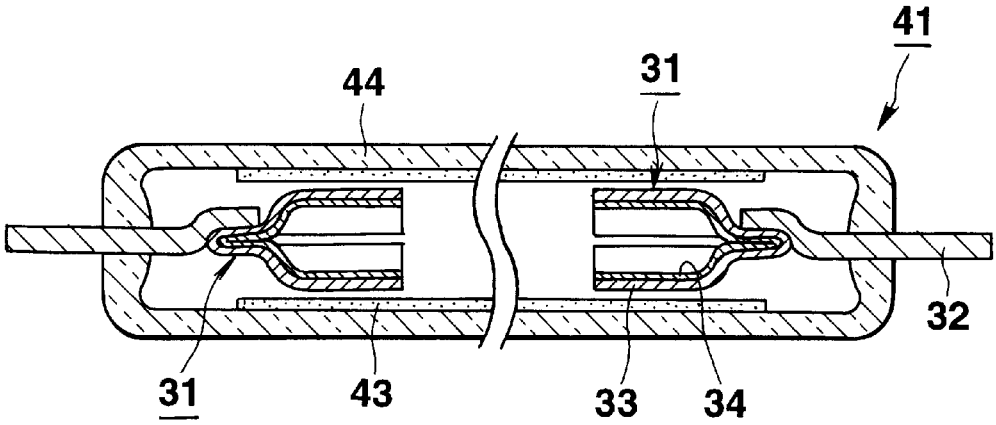
FIG. 20 is a sectional view showing an embodiment of a cold cathode discharge fluorescent tube having the above hollow cold emission electrode.
Figure 21:
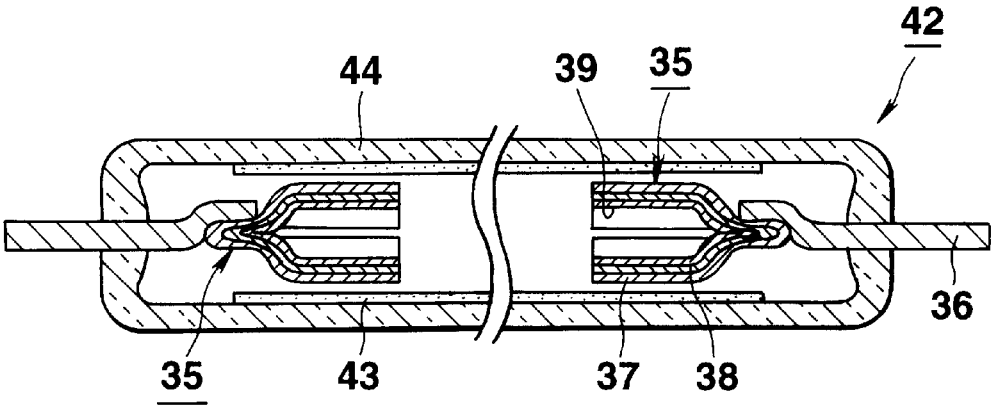
FIG. 21 is a sectional view showing another embodiment of a cold cathode discharge fluorescent tube having the above hollow cold emission electrode.

Straight cold emission discharge fluorescent tubes 41 and 42 using these hollow cold emission electrodes 31 and 35 are shown in FIGS. 20 and 21, respectively. The cold emission discharge fluorescent tube 41 or 42 has the following structure. A fluorescent material 43 for emitting light having a predetermined wavelength range in the excited state is applied to the inner surface of a glass tube 44. A pair of cold emission electrodes 31 or 35 are so disposed as to make the electron emitting layers 34 or 39 formed on the substrate 33 or 37 oppose each other in the glass tube 44. Mercury and a rare gas such as argon are sealed in the glass tube 44.

Figure 22:
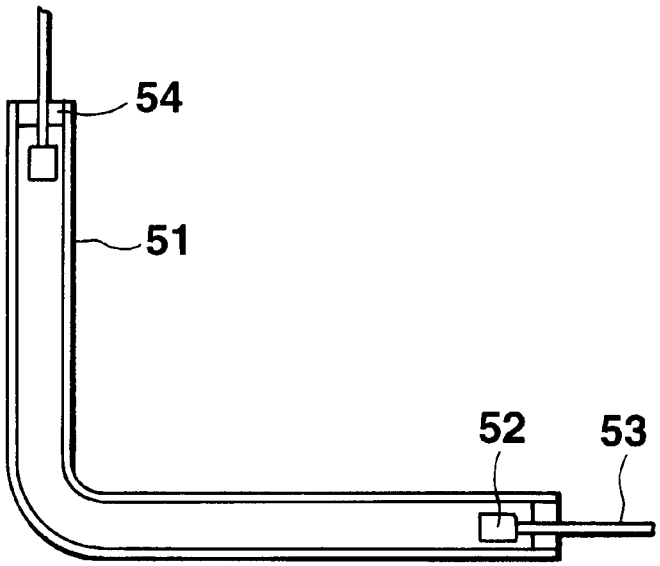
FIG. 22 is a sectional view showing an L-shaped cold emission discharge fluorescent tube according to the present invention.
Figure 23:
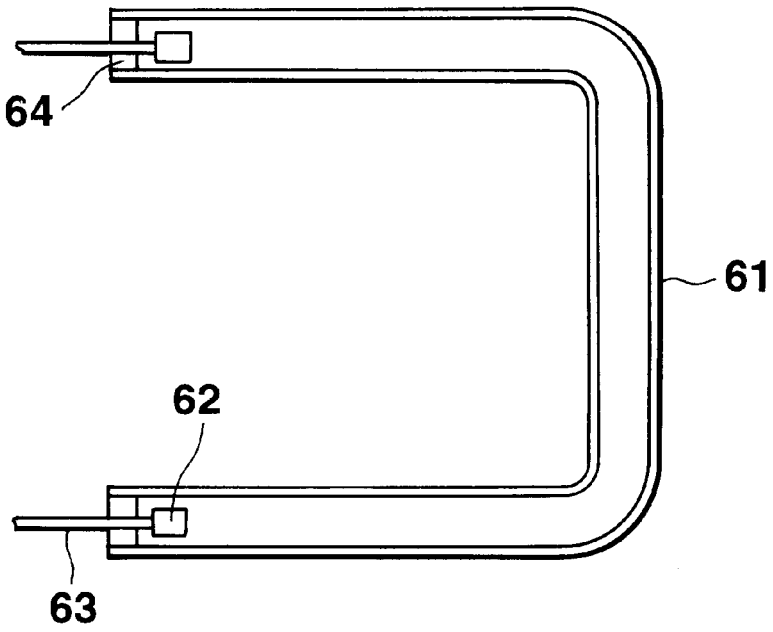
FIG. 23 is a sectional view showing a U-shaped cold emission discharge fluorescent tube according to the present invention.
Figure 24:
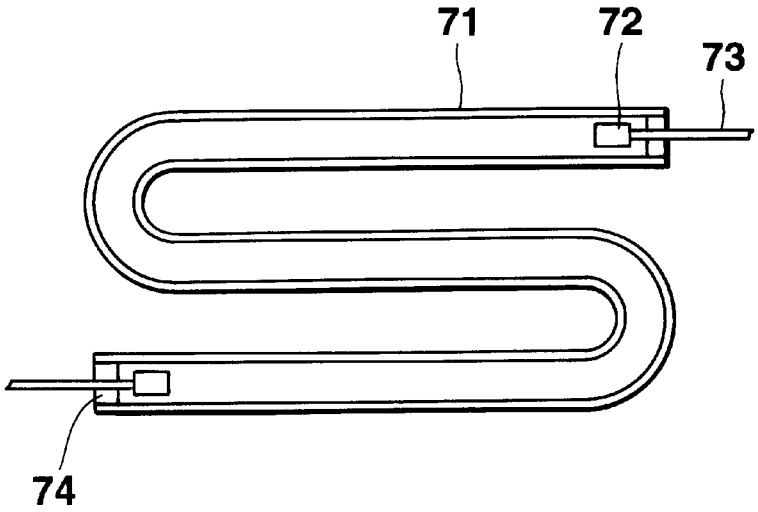
FIG. 24 is a sectional view showing a zigzag cold emission discharge fluorescent tube according to the present invention.

As shown in FIG. 22, a glass tube 51 may have an L shape. As shown in FIG. 23, a glass tube 61 may have a U shape. As shown in FIG. 24, a glass tube 71 may have a zigzag shape. Cold electron emitting electrodes 52, 62, and 72 connected to wires 53, 63, and 73 have electron emitting films made of a hydride of rare earth element so as to make fluorescent materials applied to the inner walls of the glass tubes 51, 61, and 71 emit light. The tubes are sealed by sealing members 54, 64, and 74.

Figure 25:
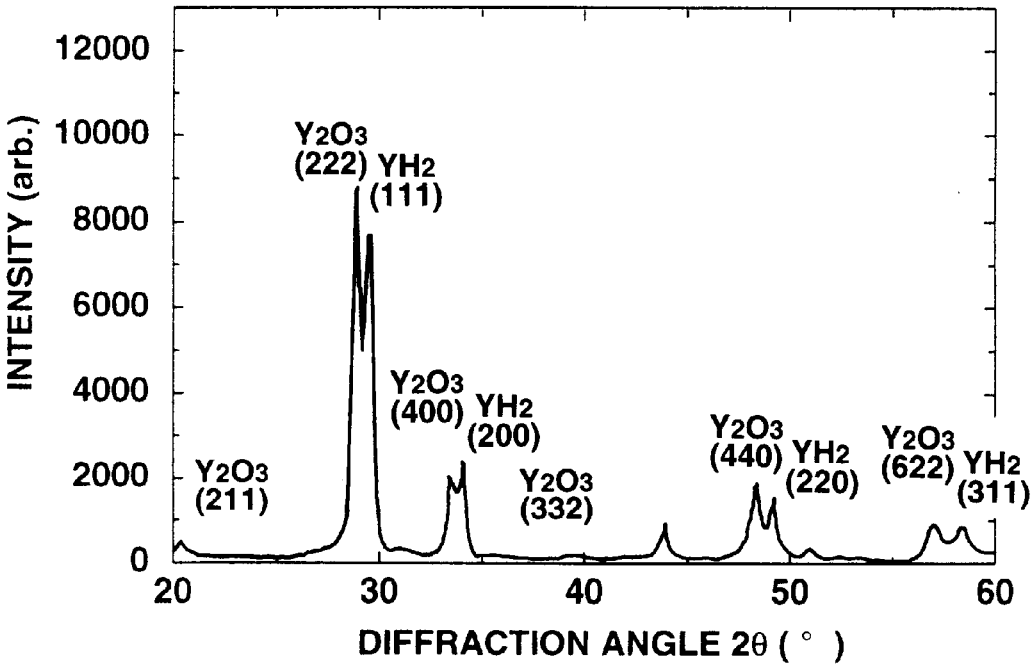
FIG. 25 is a graph showing X-ray diffraction patterns of a cold emission film containing yttrium hydride and yttrium oxide, which is manufactured under predetermined conditions.

The diffraction pattern of a hydride obtained in an atmosphere of almost 100 vol % of hydrogen at 600° C. is shown in FIG. 25. Although it is confirmed that yttrium oxide is also produced together with yttrium hydride in the presence of a very small amount of oxygen of the reaction system. Long-term discharge at a low voltage can be achieved when dehydrogenation is sufficiently performed.

The cold emission discharge fluorescent tube having the cold emission electrode is particularly used as the backlight of a liquid crystal display device of a portable battery-driven electronic equipment. The necessary power consumption of the backlight can be reduced. The service life of the battery of the portable electronic equipment can be prolonged, and the discharge voltage is kept stable for a long period of time. Therefore, power consumption will not increase in long-term use.

Figure 26:
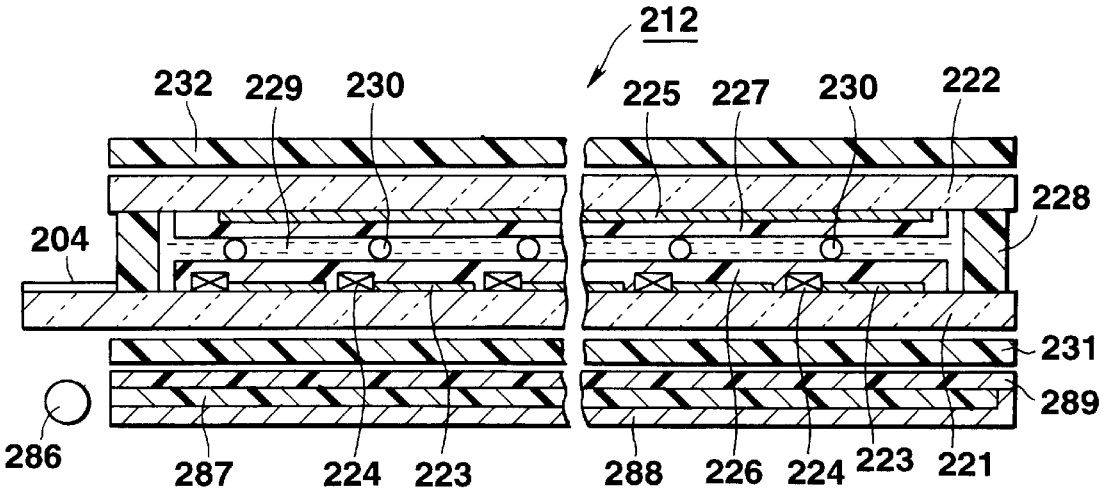
FIG. 26 is a sectional view of a liquid crystal display device to which a cold emission discharge fluorescent tube according to the present invention is applied.
Figure 27:
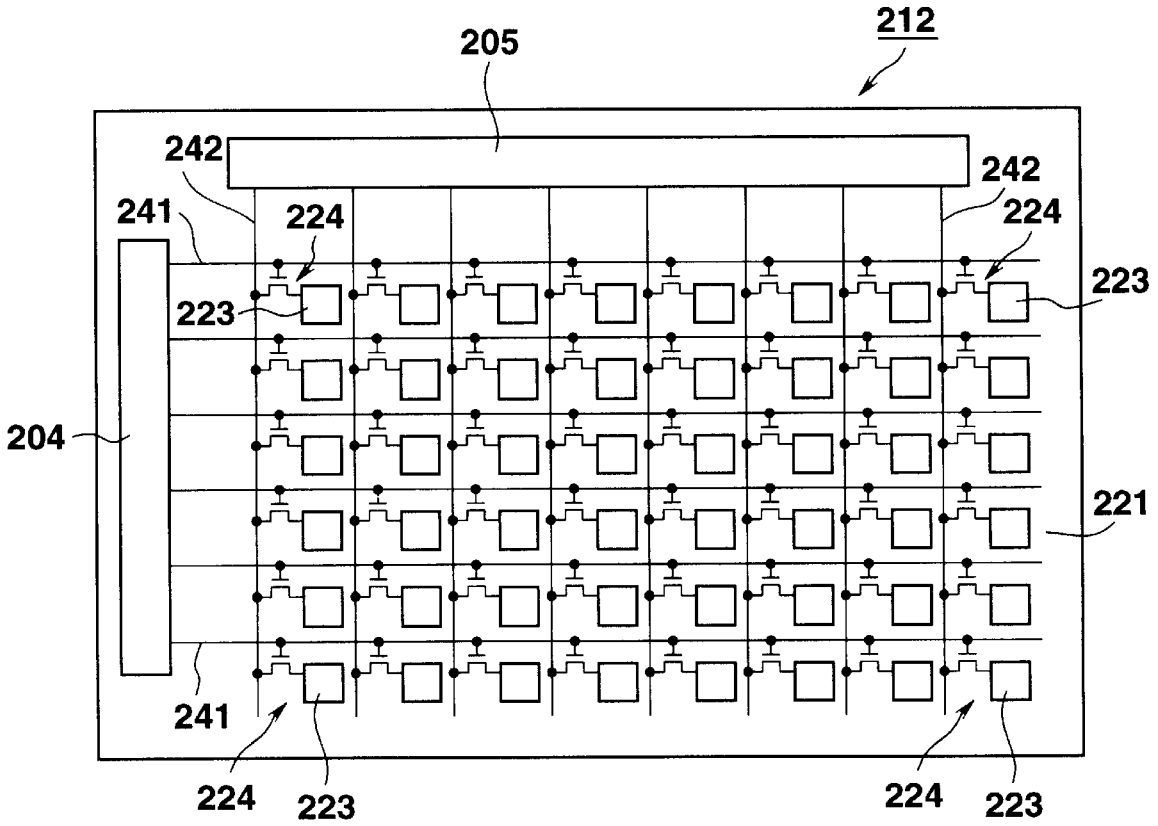
FIG. 27 is a plan view showing one substrate of the liquid crystal display device in FIG. 26.

FIG. 26 is a sectional view of a driver-integrated liquid crystal display device 212. FIG. 27 is a plan view of the liquid crystal display device shown in FIG. 26.

As shown in FIG. 26, the liquid crystal display device 212 of this embodiment has the following arrangement. A plurality of pixel electrodes 223 are formed in a matrix on one of opposing surfaces of a pair of glass substrates 221 and 222 opposing each other. FIG. 27 shows that the pixel electrodes 223 constitute pixels arranged in a matrix on the glass substrate 221. Thin film transistors (to be referred to as TFTs hereinafter) 224 serving as active switching elements are connected to the pixel electrodes 223, respectively. Each active element of the pixel portion is comprised of an amorphous silicon TFT or polysilicon TFT.

One common electrode 225 arranged to oppose the pixel electrodes is formed on almost the entire surface on the other glass substrate 222 side.

Aligning films 226 and 227 for aligning the initial direction of liquid crystal molecules are formed on the surfaces of the pixel and common electrodes 223 and 225. The pair of upper and lower glass substrates 221 and 222 are adhered to each other with a seal member 228 interposed in the peripheral portion of the substrates 221 and 222. An area surrounded by the substrates 221 and 222 and the seal member 228 is filled with a liquid crystal layer 229. Gap members 230 for keeping the distance between the substrates constant are sealed between the aligning films 226 and 227.

The liquid crystal layer 229 may be made of a TN liquid crystal whose molecules are twisted through about 90° in the direction of thickness of the substrates 221 and 222, an STN liquid crystal whose molecules are twisted through about 180° or more, a polymeric dispersed liquid crystal in which a liquid crystal is filled in the gap in a polymer having a three-dimensional net-like structure, a ferroelectric liquid crystal, an antiferroelectric liquid crystal, or the like.

The liquid crystal cells are sandwiched between upper and lower polarizing plates 231 and 232, as shown in FIG. 26. As shown in FIGS. 26 and 27, a scanning driver 204 and a signal driver 205 are integrally formed on one glass substrate 221 of the liquid crystal display device 212 by the COG technique. P- and n-channel CMOS (Complementary Metal Oxide Semi-conductor) polysilicon TFTs are used as the transistors of the driver.

As shown in FIG. 27, a plurality of scanning lines 241 extend from the scanning driver 204 and are respectively connected to the gate electrodes of TFTs 224 of the pixels arranged in the row direction. A plurality of signal lines 242 extend from the signal driver 205 and are respectively connected to the sources of the TFTs 224 of the pixels arranged in the column direction.

A driver-integrated liquid crystal display device is obtained in which the scanning driver 204 and the signal driver 205 are integrally formed on the glass substrate 221 of the liquid crystal display device 212. The mounting area can be reduced. At the same time, since an active matrix driving scheme using active elements such as TFTs is employed as the liquid crystal driving scheme, the drivers can be mounted on one glass substrate side, thereby reducing the manufacturing cost.

A cylindrical cold emission discharge fluorescent tube 286 is disposed below the liquid crystal display device 212. A light guiding plate 287 made of acrylic resin for guiding light from the cold emission discharge fluorescent tube 286 is disposed laterally from the cold emission discharge fluorescent tube 286. A reflecting plate 288 is formed on the lower surface of the light guiding plate 287. A light scattering plate 289 is formed on the upper surface of the light guiding plate 287. In the cold emission discharge fluorescent tube 286, its pair of electrodes are disposed to oppose each other. The cold emission film of each electrode contains an electrode material represented by $RH_{2+x}$ (wherein R is at least one element selected from the group consisting of Sc, Y, La, Ce, Gd, Lu, Th, U, and Np, H is hydrogen, and $-1<x<1$). This cold emission film may partially contain an oxide of the element R.

This cold emission electrode can be used not only for a cold emission discharge fluorescent tube usable for the backlight of the liquid crystal display device or a copying machine, but also as the electrode of a glow discharge device using secondary electron emission using ions in a monochrome or multicolor emission plasma display panel. In these products, the discharge voltage can be reduced and stabilize, thereby reducing the power consumption. The cold emission electrode can also be used for a field emission display device.

Figure 28:
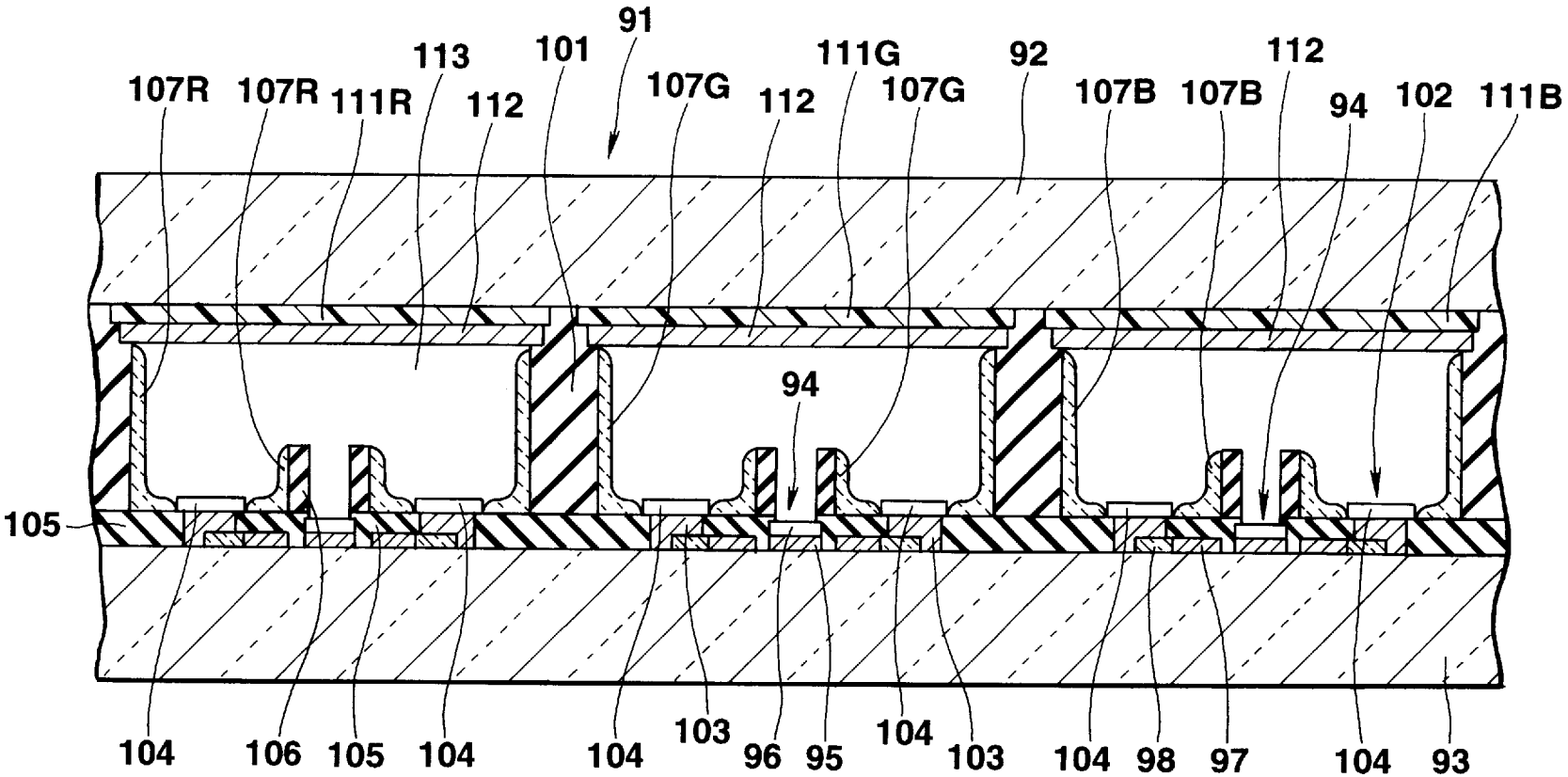
FIG. 28 is a sectional view showing an example of a plasma display panel to which a cold emission electrode of the present invention is applied.

FIG. 28 is a sectional view showing part of a DC-driven color plasma display panel. A plasma display panel 91 is comprised of a plurality of pixels for displaying red, green, and blue images. The pixels are partitioned by a matrix or striped barrier wall 101 formed between a transparent upper substrate 92 and a lower substrate 93. An auxiliary cathode electrode 94 is formed at the center of each pixel on the lower substrate 93. The auxiliary cathode electrode 94 is comprised of a base 95 made of at least one conductor selected from the group consisting of Y, Ni, Cr, Al, and Mo, and an electron emitting film 96 made of yttrium hydride as a hydride of rare earth element formed on the base 95. The electron emitting film 96 may contain yttrium oxide. A data electrode 97 is disposed around each auxiliary cathode electrode 94 to be spaced apart from the electrode 94. A current control film 98 made of amorphous silicon or the like is formed outside the data electrode 97 centered on the auxiliary cathode electrode 94. A cathode electrode 102 is disposed outside the current control film 98. The cathode electrode 102 is comprised of a base 103 made of at least one conductor selected from the group consisting of Y, Ni, Cr, Al, and Mo and an electron emitting film 104 made of yttrium hydride as a hydride of rare earth element formed on the base 103. The electron emitting film 96 may contain yttrium oxide. The current control film 98 controls the current to suppress sputtering of the cathode electrode 102. The resistance of the current control film 98 can be set by its film thickness and length, an impurity doped in amorphous silicon, and the like.

An insulating film 105 is formed on the entire surface on the lower substrate 93 except the electron emitting film 96 of the auxiliary cathode electrode 94 and the electron emitting film 104 of the cathode electrode 102. An auxiliary barrier wall 106 is formed on the insulating film 105 around the auxiliary cathode electrode 94. The barrier wall 101 and the auxiliary barrier wall 106 have a red fluorescent material 107R for emitting red light, a fluorescent material 107G for emitting green light, or a fluorescent material 107B for emitting blue light in units of pixels. Examples of the fluorescent material 107R are (Y,Gd)BO3:$Eu_3$+ and $Y_2O_3$:$Eu_3$+. Examples of the fluorescent material 107G are $Zn_2SiO_4$:Mn and $BaAl_{12}O_{19}$:Mn. Examples of the fluorescent material 107B are $BaMgAl_{14}O_{23}$:$Eu_2$+ and $SrMg(SiO_4)_2$:$Eu_2$+.

A color filter 111R for separating a red component, a color filer 111G for separating a green component, and a color filter 111B for separating a blue component are formed on the upper substrate 92 in correspondence with the red, green, and blue pixels. Transparent electrodes 112 made of ITO are formed on the surfaces of the color filters 111R, 111G, and 111B. A rare gas 113 containing He and Xe is sealed in the space surrounded by the upper electrode 92, the lower substrate 93, and the barrier wall 101.

A method of driving the plasma display panel 91 described above will be described below.

First, a predetermined voltage is applied between the transparent electrode 112 and the auxiliary cathode electrode 94 to generate an auxiliary plasma.

Second, a data voltage corresponding to a display pattern is applied the data electrode 97 of each pixel. A controlled current flows from the current control film 98 to the cathode electrode 102. A plasma can quickly be generated by the auxiliary plasma between the cathode electrode 102 and the transparent electrode 112. An ultraviolet ray is emitted from the rare gas by this plasma and is bombarded against the fluorescent material of each pixel to emit light having a predetermined wavelength range. This light passes through the upper substrate 92, and the pattern is displayed.

When external light is incident on the plasma display panel 91, the color filters 111R, 111G, and 111B separate the incident light into the respective color components. These components emerge from the upper substrate 92. In addition to emission from the fluorescent materials 107R, 107G, and 107B, colors are displayed with large hue values. Since the color filters 111R, 111G, and 111B separate the light into their color components, flickering due to variations by reflection of external light can be suppressed to clearly display the pattern.

A liquid crystal panel serving as an optical shutter may be formed on the display surface side of the plasma display panel 91. The liquid crystal panel allows fine gray level display.

A plasma display panel having the cold emission electrode containing yttrium hydride performs color display using fluorescent materials. The present invention is also applicable to a plasma display panel using orange as a display color by plasma emission without using fluorescent materials.

An example of a rare earth element used for the above plasma display panel 91 can be selected from the group consisting of Sc, La, Ce, Gd, Lu, Th, U, and Np in addition to yttrium. An oxide which may be contained together with a hydride can be selected from the group consisting of Sc, La, Ce, Gd, Lu, Th, U, and Np in addition to yttrium. The material of the substrates 95 and 103 is not limited to the one described above if the material has a lower work function than that of the transparent electrode 112 serving as the anode electrode.

Figure 29:
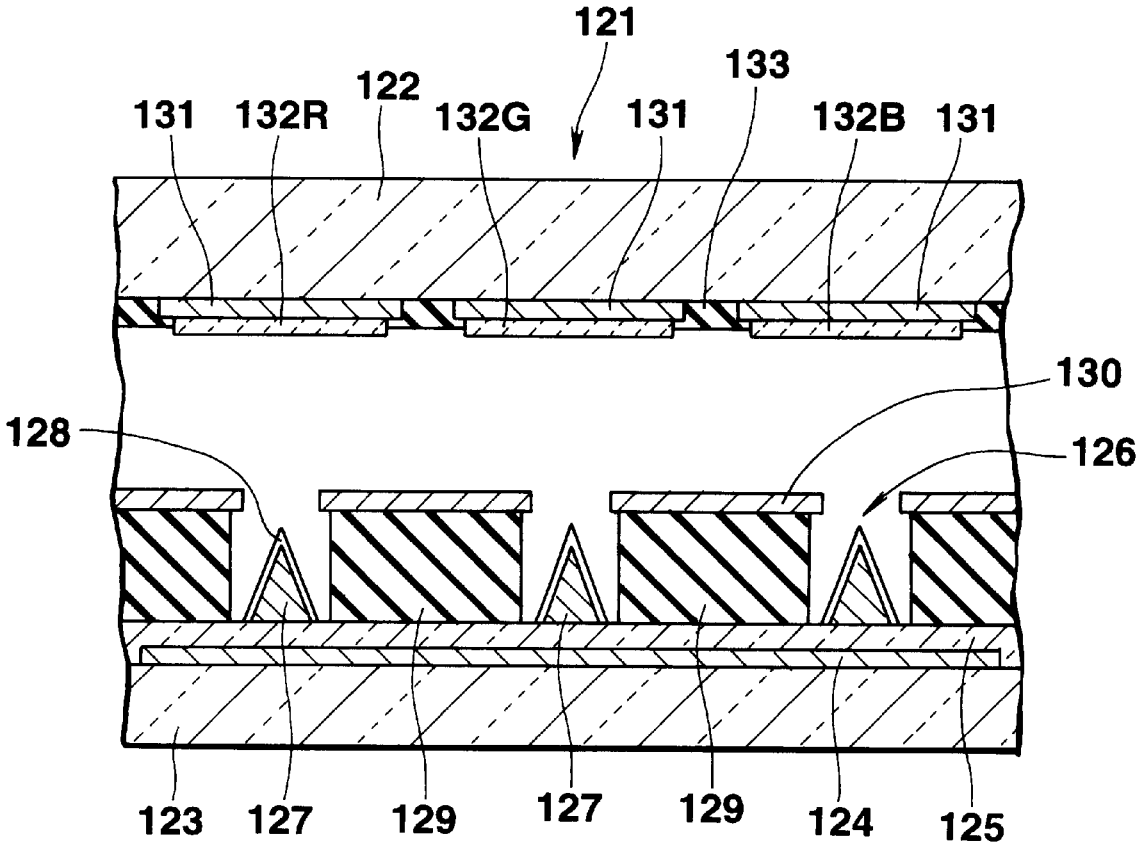
FIG. 29 is a sectional view showing an example of a field emission display device to which a cold emission electrode of the present invention is applied.

The cold emission electrode of the present invention is also applicable to a field emission display device. FIG. 29 is a sectional view showing part of a field emission display device. A field emission display device 121 is comprised of a plurality of pixels for displaying red, green, and blue images. The pixels are partitioned by a matrix or striped barrier wall between a transparent upper substrate 122 and a lower substrate 123 which are spaced apart from each other. Data electrodes 124 for receiving a brightness data voltage are formed on the lower substrate 123. A current control film 125 made of amorphous silicon is formed on the data electrode 124. About 2,000 conical cold cathodes 126 are formed per pixel on the current control film 125. Each cold cathode 126 is comprised of a conical base 127 made of an element selected from Y, Ni, Cr, Al, and Mo and an electron emitting film 128 made of yttrium hydride as a hydride of rare earth element formed on the base 127. Each cold cathode 126 is insulated from an adjacent cold cathode 126 through an insulating film 129. A gate electrode 130 is formed on the insulating film 129 while the top of the cold cathode 126 is kept open. The electron emitting film 128 may contain yttrium oxide. The current control film 125 limits the current to suppress sputtering of the cold cathode 126. The resistance of the current control film 125 can be set by its film thickness and length, an impurity doped in amorphous silicon, and the like.

A transparent electrode 131 serving as an anode electrode made of ITO is formed on the surface of the upper substrate 122 which opposes the cold cathode 126. A fluorescent material 132R for emitting red light, a fluorescent material 132G for emitting green light, and a fluorescent material 132B for emitting blue light are formed on the surfaces of the transparent electrodes 131, respectively.

A method of driving the field emission display device 121 described above will be described below.

A data voltage corresponding to each pixel is applied between the transparent electrode 131 and the data electrode 124. A current controlled via the current control film 125 flows in the base 127 of the cold cathode 126. A selection voltage is applied to the gate electrode 130 of a pixel to be displayed in color. Electrons are emitted from the electron emitting film 128 at the tip of the cold cathode 126 selected by the gate electrode 130 in accordance with the data voltage.

The emitted electrons are attracted toward the transparent electrode 131 applied with a predetermined voltage. The electrons are bombarded against the fluorescent materials 132R, 132G, and 132B on the surfaces of the transparent electrodes 131. The fluorescent materials 132R, 132G, and 132B emit visible light. The visible light passes through the transparent substrate 122 to perform a color display.

A liquid crystal panel serving as an optical shutter may be formed on the display surface side of the field emission display device 121. The liquid crystal panel allows fine gray level display.

The cold emission electrode having yttrium hydride can also be applied to a monochrome field emission display device.

An example of a rare earth element used for the above field emission display device 121 can be selected from the group consisting of Sc, La, Ce, Gd, Lu, Th, U, and Np in addition to yttrium. An oxide which may be contained together with a hydride can be selected from the group consisting of Sc, La, Ce, Gd, Lu, Th, U, and Np in addition to yttrium. The material of the base 127 is not limited to the one described above if the material has a lower work function than that of the transparent electrode 112 serving as the anode electrode.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cold emission electrode comprising an electrode substrate and a hydride formed on said electrode substrate, the hydride being made of at least one element selected from the group consisting of Sc, Y, La, Ce, Gd, Lu, Th, U, and Np.

2. A cold emission electrode according to claim 1, wherein the hydride is represented by $RH_{2+x}$ (wherein R is at least one element selected from the group consisting of Sc, Y, La, Ce, Gd, Lu, Th, U, and Np, H is hydrogen, and $-1<x<1$).

3. A cold emission electrode according to claim 1, further containing an oxide being of at least one element selected from the group consisting of Sc, Y, La, Ce, Gd, Lu, Th, U, and Np.

4. A method of manufacturing a cold emission electrode according to claim 1, comprising hydrogenating a metal film in an atmosphere containing hydrogen gas, the metal film containing at least one element selected from the group consisting of Sc, Y, La, Ce, Gd, Lu, Th, U, and Np, thereby forming a cold emission region.

5. A method of manufacturing a cold emission electrode according to claim 4, wherein said metal film is hydrogenated in an inert gas atmosphere containing rare gas and not less than 10 ppm and not more than 0.5 vol % of hydrogen gas.

6. A display device comprising:

a first substrate;

a second substrate spaced apart from said first substrate;

a first electrode provided on a surface of said first substrate which opposes the second substrate;

a second electrode provided on a surface of said second substrate which opposes said first substrate, and having an electron emitting film containing a hydride of at least one element selected from the group consisting of Sc, Y, La, Ce, Gd, Lu, Th, U, and Np, the hydride being for field emission when a predetermined voltage is applied between said first and second electrodes; and a fluorescent material for emitting visible light having a predetermined wavelength range upon receiving an electron emitted by said second electrode.

7. A cold emission discharge tube comprising a cold emission electrode containing a hydride of at least one element selected from the group consisting of Sc, Y, La, Ce, Gd, Lu, Th, U, and Np.

8. A cold emission discharge tube according to claim 7, wherein the hydride is represented by $RH_{2+x}$ (wherein R is at least one element selected from the group consisting of Sc, Y, La, Ce, Gd, Lu, Th, U, and Np, H is hydrogen, and $-1<x<1$).

9. A cold emission discharge tube according to claim 7, wherein said cold emission electrode contains an oxide of at least one element selected from the group consisting of Sc, Y, La, Ce, Gd, Lu, Th, U, and Np.

10. A display device comprising:

a cold emission tube for emitting light, having:

(A) a fluorescent tube including a tube body having an inner surface and a fluorescent layer coated on the inner surface of the tube, for emitting light falling within a wavelength range, said tube body allowing passage of light emitted from said fluorescent layer;

(B) a pair of electron emitting electrodes provided in said fluorescent tube, opposing each other, each comprising an electron emitting film containing a hydride of at least one element selected from the group consisting of Sc, Y, La, Ce, Gd, Lu, Th, U, and Np;

(C) a rare gas and mercury with which said fluorescent tube is filled; and (D) a liquid crystal display unit having a pair of substrates and liquid crystal between said pair of substrates.

11. The device according to claim 10, wherein the hydride is represented by $RH_{2+x}$ (wherein R is at least one element selected from the group consisting of Sc, Y, La, Ce, Gd, Lu, Th, U, and Np, H is hydrogen, and $-1<x<1$).

12. The device according to claim 10, wherein said electron emitting film contains an oxide of at least one element selected from the group consisting of Sc, Y, La, Ce, Gd, Lu, Th, U, and Np.

13. The device according to claim 10, further comprising a light guiding element for guiding said light from said cold emission tube to said liquid crystal display unit.

14. A display device comprising:

a first substrate;

a second substrate spaced apart from said first substrate;

a first electrode provided on a surface of said first substrate which opposes the second substrate, and having an electron emitting film containing a hydride of at least one element selected from the group consisting of Sc, Y, La, Ce, Gd, Lu, Th, U, and Np;

a second electrode provided on a surface of said second substrate which opposes said first substrate, for generating a plasma when a predetermined voltage is applied between said first and second electrodes; and a rare gas filled in a space defined by said first and second substrates.

15. The device according to claim 14, wherein the hydride is represented by $RH_{2+x}$ (wherein R is at least one element selected from the group consisting of Sc, Y, La, Ce, Gd, Lu, Th, U, and Np, H is hydrogen, and $-1<x<1$).

16. The device according to claim 14, wherein said electron emitting film contains an oxide of at least one element selected from the group consisting of Sc, Y, La, Ce, Gd, Lu, Th, U, and Np.

17. The device according to claim 14, wherein said first and second electrodes are driven by a direct current, to generate a plasma.

18. The device according to claim 6, wherein the hydride is represented by $RH_{2+x}$ (wherein R is at least one element selected from the group consisting of Sc, Y, La, Ce, Gd, Lu, Th, U, and Np, H is hydrogen, and $-1<x<1$).

19. The device according to claim 6, wherein said electron emitting film contains an oxide of at least one element selected from the group consisting of Sc, Y, La, Ce, Gd, Lu, Th, U, and Np.

* * * * *